US008084176B2

(12) United States Patent
Iwamoto et al.

(10) Patent No.: US 8,084,176 B2
(45) Date of Patent: Dec. 27, 2011

(54) TONER, DEVELOPER, AND IMAGE FORMING METHOD

(75) Inventors: Yasuaki Iwamoto, Numazu (JP); Shinya Nakayama, Numazu (JP); Yasutada Shitara, Numazu (JP); Hiroyuki Kishida, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 398 days.

(21) Appl. No.: 12/471,056

(22) Filed: May 22, 2009

(65) Prior Publication Data

US 2009/0297973 A1 Dec. 3, 2009

(30) Foreign Application Priority Data

Jun. 2, 2008 (JP) ..... 2008-144084

(51) Int. Cl.
*G03G 9/08* (2006.01)

(52) U.S. Cl. ..... 430/108.1

(58) Field of Classification Search ..... 430/108.1
See application file for complete search history.

(56) References Cited

U.S. PATENT DOCUMENTS

| | | | |
|---|---|---|---|
| 2007/0248380 | A1 | 10/2007 | Iwamoto et al. |
| 2007/0281236 | A1 | 12/2007 | Watanabe et al. |
| 2007/0281237 | A1 | 12/2007 | Iwamoto et al. |
| 2008/0118855 | A1 | 5/2008 | Nakayama et al. |
| 2008/0145775 | A1 | 6/2008 | Vijayendran et al. |
| 2008/0261131 | A1 | 10/2008 | Nakayama et al. |
| 2008/0280218 | A1 | 11/2008 | Sabu et al. |
| 2008/0280219 | A1 | 11/2008 | Nakayama et al. |
| 2008/0318143 | A1 | 12/2008 | Nakayama et al. |
| 2009/0103950 | A1 | 4/2009 | Nakayama et al. |

FOREIGN PATENT DOCUMENTS

| | | | |
|---|---|---|---|
| CN | 101189276 | A | 5/2008 |
| EP | 1 862 859 | A2 | 12/2007 |
| EP | 1 862 859 | A3 | 12/2007 |
| JP | 2597452 | | 1/1997 |
| JP | 2909873 | | 4/1999 |
| JP | 3343635 | | 8/2002 |
| JP | 2004-126066 | | 4/2004 |
| JP | 3779221 | | 3/2006 |
| JP | 3785011 | | 3/2006 |
| JP | 4050051 | | 12/2007 |
| JP | 2008-20631 | | 1/2008 |

OTHER PUBLICATIONS

Office Action issued May 25, 2011, in Chinese Patent Application No. 200910141338.8 (with English-language translation).

*Primary Examiner* — Mark Chapman
(74) *Attorney, Agent, or Firm* — Oblon, Spivak, McClelland, Maier & Neustadt, L.L.P.

(57) ABSTRACT

The present invention provides a toner which includes at least a binder resin, and a colorant, wherein the toner has a concentration of radioactive carbon isotope C-14 of 10.8 pMC or higher.

5 Claims, 6 Drawing Sheets

TONER, DEVELOPER, AND IMAGE FORMING METHOD

BACKGROUND OF THE INVENTION

1. Field of the Invention

The present invention relates to a toner used for a developer for developing a latent electrostatic image in electrophotography, electrostatic recording, electrostatic printing, or the like; a developer using the toner, and an image forming method using the toner.

2. Description of the Related Art

Generally, the term "carbon neutral" is used as a definition relating to biomass materials composed of organic materials. When such a biomass material is burned, carbon dioxide is released to the atmosphere, and the carbon contained in the carbon dioxide is derived from a carbon dioxide that has been absorbed by the biomass material through photosynthesis from the atmosphere in the process of growing. Therefore, it can be considered that even when such biomass materials are used, the amount of carbon dioxide in the air will not increase as a whole. Such a nature or property is referred to as "carbon neutral".

Conventionally, components of toner, in particular, binder resins are substantially dependent on fossil resources, and thus it is said that carbon dioxide released from discarded toner and paper printouts is brought back into air, causing global warming, etc. The conversion from limited resources of fossils to biomass resources as reproducible resources can also be said to be a conversion into continuously reproducible resources, in terms that living organisms are produced from solar energy, water, and carbon dioxide. The conversion technology has been desired.

As components of a toner obtained from such reproducible resources, releasing agents such as carnauba wax, Candelilla wax, are exemplified. These releasing agents are mixed in toner to impart releasing properties to the toner during fixing. Since the amount of a releasing agent mixed therein is usually several percent by mass, only mixing of the releasing agent is far from satisfaction in view of carbon neutral.

Meanwhile, as to a technology focused on biodegradability from the viewpoint of environmental protection, use of biodegradable resins such as polylactic acids (PLAs) as binder resins in toner is studied. For instance, the following have been proposed: (1) a toner containing a polylactic acid (PLA) obtained by dewatering condensation (see Japanese Patent (JP-B) No. 3343635), (2) a toner containing a terminal-modified PLA (see Japanese Patent (JP-B) No. 2909873), (3) a toner containing a copolymer between terpene phenol and PLA as essential ingredients (see Japanese Patent (JP-B) Nos. 3785011 and 3779221), (4) a toner using PLA whose particle size and particle size distribution are defined (Japanese Patent Application Laid-Open (JP-A) No. 2004-126066), and (5) a toner containing a biodegradable resin and a vegetable wax in which the amount of wax ester is specified (see Japanese Patent (JP-B) No. 2597452).

However, in reality, a toner using biomass material required for sufficiently meeting requirements for carbon neutral and technologies related thereto have not yet been proposed so far.

BRIEF SUMMARY OF THE INVENTION

An object of the present invention is to provide a toner which has a concentration of radioactive carbon isotope $^{14}C$ of 10.8 pMC or higher, makes a significant contribution to biomass production and can meet a desired image quality, a developer using the toner, and an image forming method using the toner.

The following are means for solving the aforesaid problems:

<1> A toner including at least:
- a binder resin, and
- a colorant,
- wherein the toner has a concentration of radioactive carbon isotope $^{14}C$ of 10.8 pMC or higher.

<2> The toner according to <1>, wherein the binder resin is a polyester resin obtained by polycondensation of an alcohol component with a carboxylic acid component containing a rosin compound in an amount of 5% by mass or more relative to the total mass of the alcohol component and the carboxylic acid component, and the amount of the polyester resin contained in the toner is 20 parts by mass or more relative to 100 parts by mass of the total amount of the toner.

<3> The toner according to one of <1> and <2>, wherein the binder resin comprises at least a polyester resin (A) and a polyester resin (B) whose softening point is 10° C. or more higher than the softening point of the polyester resin (A), and at least one of the polyester resins (A) and (B) contains a resin derived from a (meth)acrylic acid-modified rosin having a polyester unit which is obtained by polycondensation of an alcohol component with a carboxylic acid component containing a (meth)acrylic acid-modified rosin.

<4> A developer including:
- the toner according to any one of <1> to <3>, and
- a carrier.

<5> An image forming method including:
- forming a latent electrostatic image on a surface of a latent electrostatic image bearing member,
- developing the latent electrostatic image using a toner to form a visible image,
- transferring the visible image onto a recording medium, and
- fixing the transferred image on the recording medium,
- wherein the toner is the toner according to any one of <1> to <3>.

<6> An Image Forming Apparatus Including at Least:
- a latent electrostatic image bearing member,
- a latent electrostatic image forming unit configured to form a latent electrostatic image on a surface of the latent electrostatic image bearing member,
- a developing unit configured to develop the latent electrostatic image using a toner to form a visible image,
- a transfer unit configured to transfer the visible image onto a recording medium, and
- a fixing unit configured to fix the transferred image on the recording medium,
- wherein the toner is the toner according to any one of <1> to <3>.

<7> A process cartridge detachably mounted on a main body of an image forming apparatus, the process cartridge including at least:
- a latent electrostatic image bearing member, and
- a developing unit configured to develop a latent electrostatic image formed on a surface of the latent electrostatic image bearing member using a toner,
- wherein the toner is the toner according to any one of <1> to <3>.

According to the present invention, it is possible to solve problems in related art and to provide a toner which has a concentration of radioactive carbon isotope $^{14}C$ of 10.8 pMC or higher, makes a significant contribution to biomass production and can meet a desired image quality, a developer using the toner, and an image forming method using the toner.

DETAILED DESCRIPTION OF THE INVENTION (Toner)

Figure 1:
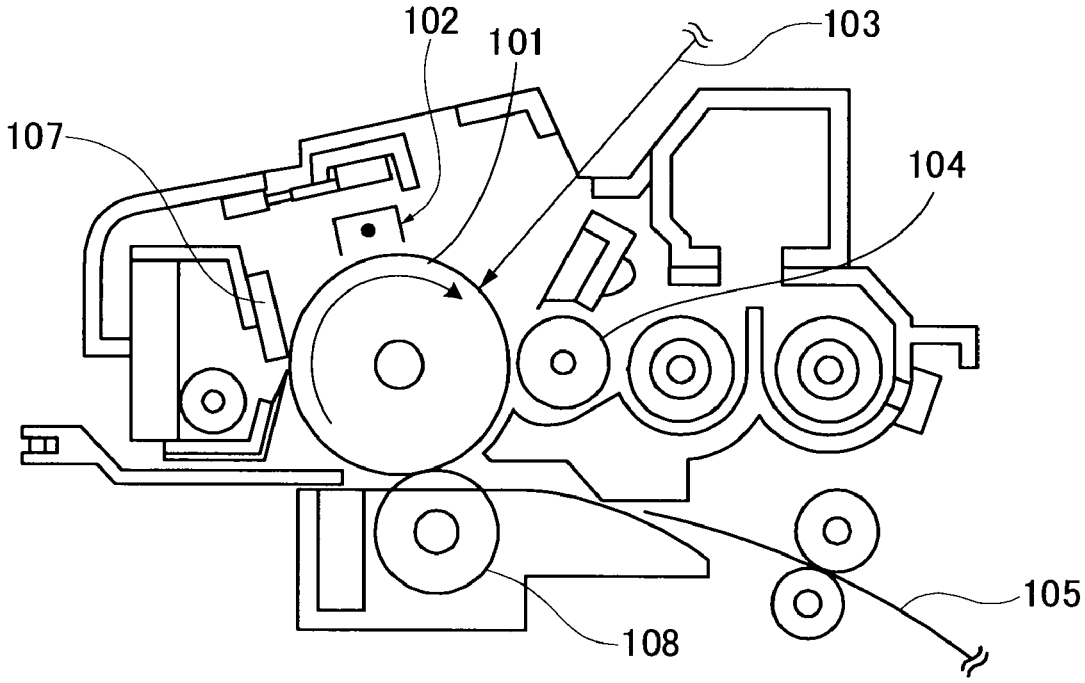
FIG. 1 is a schematic diagram showing one example of a process cartridge used in the present invention.

A toner of the present invention contains at least a binder resin, and a colorant, may contain a releasing agent, a charge controlling agent, external additives, and other components in accordance with the necessity.

The toner needs to have a concentration of radioactive carbon isotope C-14 (Carbon-14) of 10.8 pMC or higher, more preferably 20 pMC or higher. When the concentration of radioactive carbon isotope C-14 is less than 10.8 pMc, it may be recognized that the degree of biomass disruption is low, and thus an object of the present invention may not be achieved.

The concentration of radioactive carbon isotope C-14 is represented as a biomass disruption degree by the following equation:

Biomass disruption degree=Concentration of Carbon-14 (pMC)×0.935

The C-14 concentration of 10.8 pMC or higher means that the degree of biomass disruption is 10% or higher, which is desired from the viewpoint of carbon neutral, as well.

In order to achieve a biomass disruption degree of 10% or higher, biomass utilization of not only wax(es) in the toner but also binder resin(s) therein should be taken into account, which is the most important point in constituting a toner of the present invention.

Measuring method of the C-14 concentration is not particularly limited and may be suitably selected in accordance with the intended use. However, radioactive carbon dating is particularly preferred, in which a toner is burned, $CO_2$ (carbon dioxide) in the burned toner is reduced so as to obtain C (graphite), and the concentration of C-14 of the graphite is measured by AMS (Accelerator Mass Spectroscopy). Details of the AMS measurement procedure are found, for example, in Japanese Patent (JP-B) No. 4050051, or the like.

The C-14 is present in the natural world (in the air). During activities of plant insides, C-14 is captured in plants by photosynthesis, and the concentration of C-14 therein is equilibrated with the concentration of C-14 resides in the air, i.e., 107.5 pMC, however, the capturing of C-14 by photosynthesis is stopped at and after the stage that the living organism stops its vital activity, the capturing by photosynthesis ceases, and the concentration of C-14 by photosynthesis decreases in accordance with a half-life of C-14 of 5,730 years.

Several hundred thousand years to several hundred million years have passed since fossil resources arising from living organisms stop their vital activities, and thus no C-14 concentration is detected therefrom.

Accordingly, in order to achieve 10% or higher biomass disruption degree, which is required in practicing the present invention, it is necessary to use a material (binder resin) derived from non-fossil resources. Such a binder resin derived from non-fossil resources may be a material obtained from any starting materials and by any techniques, however, particularly preferably, it is selected from the after-mentioned binder resins.

—Binder Resin—

The binder resin is preferably a polyester resin obtained by polycondensation of an alcohol component with a carboxylic acid component containing a rosin compound in an amount of 5% by mass or more relative to the total mass of the alcohol component and the carboxylic acid component.

Further, the binder resin preferably contains at least a polyester resin (A), and a polyester resin (B) whose softening point is 10° C. or more higher than that of the polyester resin (A), and at least one of the polyester resins (A) and (B) preferably contains a resin derived from a (meth)acrylic acid-modified rosin having a polyester unit which is obtained by polycondensation of an alcohol component with a carboxylic acid component containing a (meth)acrylic acid-modified rosin.

In order to achieve a biomass disruption degree of 10% or higher, which is required in practicing the present invention, the amount of the polyester resin is preferably 20 parts by mass or more, more preferably 40 parts by mass or more, and still more preferably 50 parts by mass or more relative to 100 parts by mass of the total amount of the toner.

—Carboxylic Acid Component—

The present invention is characterized by the fact that in the polyester resin for toner, which is obtained by polycondensation of an alcohol component with a carboxylic acid component, a (meth)acrylic acid-modified rosin is contained in the carboxylic acid component. This (meth)acrylic acid-modified rosin allows the resulting toner to be fixed at an extremely low fixing temperature and to improve the storage stability. A maleic acid-modified rosin which is modified with a maleic acid, which has been conventionally used as a modified rosin, has three functional groups, and thus it serves as a crosslinker. Therefore, a polyester resin obtained by use of a carboxylic acid component containing a large amount of a maleic acid-modified rosin for the purpose of improving the fixability contains a large amount of low-molecular weight component(s) and polymeric component(s), and thus it is difficult for the polyester resin to satisfy both the storage stability and the low-temperature fixability. Conversely, when the amount of a maleic acid-modified rosin is reduced, the low-temperature fixability of the resulting polyester resin degrade. However, since the (meth)acrylic acid-modified rosin used in the present invention is a rosin having two functional groups, it can extend the molecular chain as part of the main chain of a polyester resin to increase its molecular weight, whereas, the amount of low-molecular weight components having a weight average molecular weight of 500 or lower, i.e. residual monomer components and oligomer components, is reduced, and thereby it is presumed that the use of the (meth)acrylic acid-modified rosin makes it possible to exert a marvelous effect of satisfying both low-temperature fixability and storage stability, which are mutually contradictory physical properties.

The (meth)acrylic acid-modified rosin in the present invention is a rosin modified with a (meth)acrylic acid, and can be obtained by an addition reaction of a rosin mainly containing abietic acid, neoabietic acid, palustric acid, pimaric acid, isopimaric acid, sandaracopimaric acid, dehydroabietic acid, and levopimaric acid, with a (meth)acrylic acid. More specifically, it can be obtained by subjecting levopimaric acid, abietic acid, neoabietic acid and palustric acid each having a conjugate double bond in the main components of the rosin, to a Diels-Alder reaction with a (meth)acrylic acid, under heating.

In the description of the present invention, the term "(meth) acrylic" means "methacrylic" or "acrylic", thus the term "(meth)acrylic acid" means "methacrylic acid" or "acrylic acid", and the term "(meth)acrylic-modified rosin" means "a rosin that has been modified with an acrylic acid" or "a rosin that has been modified with a methacrylic acid". The (meth) acrylic acid-modified rosin in the present invention is preferably an acrylic acid-modified rosin that has been modified with an acrylic acid, which has less steric hindrance, from the viewpoint of reaction activity of the Diels-Alder reaction.

The modification degree of the rosin by the (meth)acrylic acid, i.e., the (meth)acrylic acid-modified degree of the rosin, is preferably 5 to 105, more preferably 20 to 105, still more preferably 40 to 105, and particularly preferably 60 to 105, from the viewpoint of increasing the molecular weight of polyester resin and reducing low-molecular weight oligomer components.

The (meth)acrylic acid-modified degree can be calculated by the following Equation (1):

$$\text{(Meth)acrylic acid-modified degree} = \frac{X_1 - Y}{X_2 - Y} \times 100 \qquad \text{Equation (1)}$$

In Equation (1), $X_1$ represents an SP value of a (meth) acrylic acid-modified rosin used to calculate the modification value; $X_2$ represents a saturated SP value of a (meth)acrylic acid-modified rosin obtained by reacting 1 moL of acrylic acid with 1 moL of rosin; and Y represents an SP value of the rosin.

The term "SP value" means a softening point measured by the after-mentioned ring and ball automatic softening point measuring apparatus. The term "saturated SP value" means an SP value obtained when the reaction between a (meth) acrylic acid and a rosin is performed until the SP value of the resulting (meth)acrylic acid-modified rosin reaches a saturated value. It should be noted that the numerator in Equation (1) means an increased degree of SP value or the rosin modified with the (meth)acrylic acid, and thus the greater the value is the higher the modification degree is.

Production method of the (meth)acrylic acid-modified rosin is not particularly limited and may be suitably selected in accordance with the intended use. For instance, a rosin is mixed with a (meth)acrylic acid to prepare a mixture, the mixture is subjected to a Diels-Alder reaction by heating at about 180° C. to 260° C. so that the (meth)acrylic acid is added to acids each having a conjugate double bond contained in the rosin, thereby obtaining a (meth)acrylic acid-modified rosin. The (meth)acrylic acid-modified rosin may be directly used, or may be used after being further purified through a treatment such as distillation.

The rosin used for the (meth)acrylic acid-modified rosin in the present invention may be selected from conventionally known rosins, without particular limitation, as long as the rosin mainly contains abietic acid, neoabietic acid, palustric acid, pimaric acid, isopimaric acid, sandaracopimaric acid, dehydroabietic acid, and levopimaric acid, derived from, such as, natural rosins obtainable from pines, isomerized rosins, dimerized rosins, polymerized rosins, and disproportionated rosins. From the viewpoint of color, natural rosins such as toll rosin obtainable as a by-product from tall oil in a production process of natural rosin pulp, gum rosin obtainable from crude pine tar, and wood rosin obtainable from pine stubs, are preferable. From the viewpoint of low-temperature fixability, tall rosin is more preferably used.

The (meth)acrylic acid-modified rosin in the present invention is obtained through a Diels-Alder reaction under heating, and thus the amount of impurities causing odor is suppressed low, and it emits less odor. However, from the viewpoint of further suppressing the odor and improving the storage stability, it is preferable to use a (meth)acrylic acid-modified rosin obtained by modifying a purified rosin with a (meth) acrylic acid, and it is more preferable to use a (meth)acrylic acid-modified rosin obtained by modifying a purified tall rosin with a (meth)acrylic acid.

The purified rosin used in the present invention is a rosin whose impurities are reduced by a purification process. By purifying a rosin, impurities contained in the rosin are removed. Examples of main impurities contained therein include 2-methylpropane, acetaldehyde, 3-methyl-2-butanone, 2-methylpropanic acid, butanoic acid, pentanoic acid, n-hexanal, octane, hexanoic acid, benzaldehyde, 2-pentylfuran, 2,6-dimethylcyclohexanone, 1-methyl-2-(1-methylethyl)benzene, 3,5-dimethyl-2-cyclohexene, and 4-(1-methylethyl)benzaldehyde. Peak intensities of three impurities including hexanoic acid, pentanoic acid and benzaldehyde among these impurities, which are detected as volatile components by the Headspace GC-MS method can be used as indexes of the purified rosin. The reason of using, as indexes, peak intensities of the volatile components, not using the absolute value of impurities is that the present invention proposes an improvement in odor property of the polyester resin by the use of a purified rosin, in contrast to conventional polyesters using rosins.

In other words, in the present invention, the purified rosin is a rosin which has, in the after-mentioned measurement conditions for the Headspace GC-MS method, a peak intensity of hexanoic acid of $0.8\times10^7$ or lower, a peak intensity of pentanoic acid of $0.4\times10^7$ or lower, and a peak intensity of benzaldehyde of $0.4\times10^7$ or lower. Further, from the viewpoint of storage stability and odor property, the peak intensity of the hexanoic acid is preferably $0.6\times10^7$ or lower, more preferably $0.5\times10^7$ or lower; the peak intensity of the pentanoic acid is preferably $0.3\times10^7$ or lower, more preferably $0.2\times10^7$ or lower; and the peak intensity of the benzaldehyde is preferably $0.3\times10^7$ or lower, more preferably $0.2\times10^7$ or lower.

Furthermore, from the viewpoint of storage stability and odor property, it is preferable that the amounts of n-hexanal and 2-pentylfuran be reduced, in addition to the amounts of the above-mentioned three impurities. The peak intensity of n-hexanal is preferably $1.7\times10^7$ or lower, more preferably $1.6\times10^7$ or lower, and still more preferably $1.5\times10^7$ or lower. The peak intensity of 2-pentylfuran is preferably $1.0\times10^7$ or lower, more preferably $0.9\times10^7$ or lower, and still more preferably $0.8\times10^7$ or lower.

As a purification method of the rosin, a conventionally known method may be employed. For example, methods utilizing distillation, re-crystallization, extraction, etc. are exemplified. Preferably, the rosin is preferably purified by distillation. As the distillation method, for example, the methods described in Japanese Patent Application Laid-Open (JP- A) No. 7-286139 may be utilized, and preferred are reduced-pressure distillation, molecular distillation, steam distillation, etc., however, the rosin is preferably purified by reduced-pressure distillation. For instance, the distillation is commonly performed under a pressure of 6.67 kPa or lower and at a still temperature of 200° C. to 300° C. Common distillation methods, including simple distillation, thin film distillation, rectification, etc can be employed. Under typical distillation conditions, 2% by mass to 10% by mass of polymeric components relative to the charged rosin is removed as pitch, concurrently with removing 2% by mass to 10% by mass of initial fractions.

The softening point of the rosin before being modified, (unmodified rosin) is preferably 50° C. to 100° C., more preferably 60° C. to 90° C., and still more preferably 65° C. to 85° C. In the present invention, the softening point of the (unmodified) rosin means a softening point measured after being melted once by the method described below and then naturally cooled at a temperature of 25° C. and a relative humidity of 50% for one hour.

Further, the acid value of the unmodified rosin is preferably 100 mgKOH/g to 200 mgKOH/g, more preferably 130 mgKOH/g to 180 mgKOH/g, and still more preferably 150 mgKOH/g to 170 mgKOH/g.

The amount of the (meth)acrylic acid-modified rosin contained in the carboxylic acid component is preferably 5% by mass or more, and more preferably 10% by mass or more, from the viewpoint of low-temperature fixability. Further, from the viewpoint of storage stability, it is preferably 85% by mass or less, more preferably 65% by mass or less, and still more preferably 50% by mass or less. From the viewpoint of both of these properties, the amount of the (meth)acrylic acid-modified rosin in the carboxylic acid component is preferably from 5% by mass to 85% by mass, more preferably from 5% by mass to 65% by mass, and still more preferably from 10% by mass to 50% by mass.

Examples of carboxylic acid compounds other than the (meth)acrylic acid-modified rosin contained in the carboxylic acid component include aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and n-dodecenylsuccinic acid; aromatic dicarboxylic acids such as phthalic acid, isophthalic acid, and terephthalic acid; alicyclic dicarboxylic acids such as cyclohexane dicarboxylic acid; trivalent or higher polyvalent carboxylic acids such as trimellitic acid, and pyromellitic acid; and anhydrides of these acids; or alkyl esters of these acids each having 1 to 3 carbon atoms. It should be noted that the acids described above, the anhydrides of these acids, and alkyl esters of these acids are collectively called "carboxylic acid compound(s)" in the description of the present invention.

—Alcohol Component—

From the viewpoint of chargeability and durability, it is preferable that an alkylene oxide adduct of bisphenol A represented by the following General Formula (I) be contained in the alcohol component.

General Formula (I)

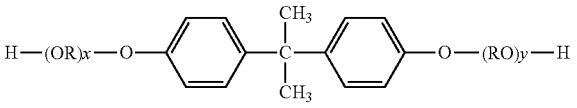

In General Formula (I), RO represents an alkylene oxide; R represents an alkylene group having 2 or 3 carbon atoms; x and y each are a positive number representing the average number of added moles, and the sum of x and y is preferably 1 to 16, more preferably 1 to 8, and still more preferably 1.5 to 4.

Examples of the alkylene oxide adduct of bisphenol A represented by General Formula (I) include alkylene (2 or 3 carbon atoms) oxide (average number of added moles: 1 to 16) adducts of bisphenol A such as polyoxypropylene (2.2)-2,2-bis(4-hydroxyphenyl)-propane, and polyoxyethylene (2.2)-2,2-bis(4-hydroxyphenyl)-propane.

The amount of the compound represented by General Formula (I) contained in the alcohol component is preferably 30 mole % or more, more preferably 50 mole % or more, still more preferably 80 mole % or more, and virtually, particularly preferably, 100 mole %.

As other alcohol components, ethylene glycol, propylene glycol, neopentyl glycol, glycerin, pentaerythritol, trimethylolpropane, hydrogenated bisphenol A, sorbitol, or alkylene (2 to 4 carbon atoms) oxide (average number of added moles: 1 to 16) adducts thereof.

In the polyester resin, it is preferable that in order to reducing residual monomer contents and improving the fixability, trivalent or higher polyvalent alcohol and/or a trivalent or higher polyvalent carboxylic acid compound be contained in the alcohol component or the carboxylic acid component, within a range that does not impair the storage stability. From the viewpoint of improving storage stability and reducing residual monomer contents, the amount of the trivalent or higher polyvalent carboxylic acid compound is preferably 0.001 moL to 40 moL, and more preferably 0.1 moL to 25 moL relative to 100 moL of the alcohol component; and the amount of the trivalent or higher polyvalent alcohol in the alcohol component is preferably 0.001 mole % to 40 mole %, and more preferably 0.1 mole % to 25 mole %.

In a trivalent or higher polyvalent material monomer, as a trivalent or higher polyvalent carboxylic acid compound, trimellitic acid or a derivative thereof is preferred; and as a trivalent or higher polyvalent alcohol, glycerin, pentaerythritol, trimethylolpropane, sorbitol or alkylene (2 to 4 carbon atoms) oxide (average number of added moles: 1 to 16) adducts thereof are exemplified. Of these, glycerin, trimellitic acid or derivatives thereof are preferred in terms that not only they become branched sites or work as a crosslinker, but also they are effective in improving low-temperature fixability.

—Esterified Catalyst—

The polycondensation of the alcohol component with the carboxylic acid component is preferably performed in the presence of an esterified catalyst. As the esterified catalyst, Lewis acids such as p-toluene sulfonic acid, titanium compounds, and tin (II) compounds having no Sn—C bond are exemplified. These esterified catalysts may be used alone or in combination. Of these, titanium compounds and tin (II) compounds having no Sn—C bond are particularly preferable.

As the titanium compounds, titanium compounds having a Ti—O bond are preferable, and titanium compounds having an alkoxy group, an alkenyloxy group or an acyloxy group, each having 1 to 28 carbon atoms in total.

Examples of the titanium compounds include titanium diisopropylate bis(triethanol aminate)[$Ti(C_{6H14}O_3N)_2(C_3H_7O)_2$], titanium diisopropylate bis(dimethanol aminate)[$Ti(C_4H_{10}O_2N)_2(C_3H_7O)_2$], titanium dipentylate bis(triethanol aminate)[$Ti(C_6H_{14}O_3N)_2(C_5H_{11}O)_2$], titanium diethylate bis(triethanol aminate)[$Ti(C_6H_{14}O_3N)_2(C_2H_5O)_2$], titanium dihydroxyoctylate bis(triethanol aminate)[Ti $(C_6H_{14}O_3N)_2(OHC_8H_{16}O)_2]$, titanium distearate bis(triethanol aminate)$[Ti(C_6H_{14}O_3N)_2(C_{18}H_{37}O)_2]$, and titanium triisopropylate triethanol aminate$[Ti(C_6H_{14}O_3N)_1(C_3H_7O)_3]$, and titanium monopropylate tris(triethanol aminate)$[Ti(C_6H_{14}O_3N)_3(C_3H_7O)_1]$. Of these, titanium diisopropylate bis(triethanol aminate), titanium diisopropylate bis(dimethanol aminate), and titanium dipentylate bis(triethanol aminate) are particularly preferable, and they are commercially available from Matsumoto Trading Co., Ltd.

Specific examples of the other preferred titanium compounds are tetra-n-butyltitanate$[Ti(C_4H_9O)_4]$, tetrapropyl titanate$[Ti(C_3H_7O)_4]$, tetrastearyl titanate$[Ti(C_{18}H_{37}O)_4]$, tetramyristyl titanate$[Ti(C_{14}H_{29}O)_4]$, tetraoctyl titanate$[Ti(C_8H_{17}O)_4]$, dioctyldihydroxyoctyl titanate $[Ti(C_8H_{17}O)_2(OHC_8H_{16}O)_2]$, and dimyristyl dioctyl titanate $[Ti(C_{14}H_{29}O)_2(C_8H_{17}O)_2]$. Of these, tetrastearyl titanate, tetramyristyl titanate, tetraoctyl titanate, and dioctyl dihydroxyoctyl titanate are preferred, and they can be obtained by reacting, for example, halogenated titanate with corresponding alcohol, and are also commercially available from Nisso Co., etc.

The amount of the titanium compound present is preferably 0.01 parts by mass to 1.0 part by mass, and more preferably 0.1 parts by mass to 0.7 parts by mass relative to 100 parts by mass of the total amount of the alcohol component and the carboxylic acid component.

As the tin (II) compound having no Sn—C bond, tin (II) compounds having an Sn—O bond, and tin (II) compounds having an Sn—X (X represents a halogen atom) bond are preferable. Tin (II) compounds having an Sn—O bond are more preferable.

Examples of the tin (II) compounds having an Sn—O bond include tin (II) carboxylate having a carboxylic group with 2 to 28 carbon atoms, such as tin (II) oxalate, tin (II) diacetate, tin (II) dioctanoate, tin (II) dilaurate, tin (II) distearate, and tin (II) dioleate; dialkoxy tin (II) having an alkoxy group with 2 to 28 carbon atoms, such as tin (II) dioctyloxy tin (II), dilauloxy tin (II), distearoxy tin (II), and dioleyloxy tin (II); tin (II) oxides; and tin (II) sulfates.

As the tin (II) compounds having an Sn—X (X represents a halogen atom) bond, for example, halogenated tin (II) such as tin (II) chloride, and tin (II) bromide are exemplified. Of these, in terms of effectiveness of charge rising property, and catalyst performance, a fatty acid tin (II) represented by $(R^1COO)_2Sn$ (where $R^1$ represents an alkyl group or alkenyl group having 5 to 19 carbon atoms), a dialkoxy tin (II) represented by $(R^2O)_2Sn$ (where $R^2$ represents an alkyl group or alkenyl group having 6 to 20 carbon atoms), and a tin (II) oxide represented by SnO are preferable. Of these, a fatty acid tin (II) represented by $(R^1COO)_2Sn$ and tin (II) oxide are more preferable; and tin (II) dioctanoate, tin (II) distearate, and tin (II) oxide are still more preferable.

The amount of the tin (II) compound having no Sn—C bond present is preferably 0.01 parts by mass to 1.0 part by mass, and more preferably 0.1 parts by mass to 0.7 parts by mass relative to 100 parts by mass of the total amount of the alcohol component and the carboxylic acid component.

When the titanium compound is used in combination with the tin (II) compound having no Sn—C bond, the total amount of the titanium compound and the tin (II) compound is preferably 0.01 parts by mass to 1.0 part by mass, and more preferably 0.1 parts by mass to 0.7 parts by mass relative to 100 parts by mass of the total amount of the alcohol component and the carboxylic acid component.

The polycondensation of the alcohol component with the carboxylic acid component can be performed, for example, in the presence of the above-mentioned esterified catalyst and in an inert gas atmosphere at a temperature of 180° C. to 250° C.

The softening point of the polyester resin is preferably 90° C. to 160° C., more preferably 95° C. to 155° C., and still more preferably 100° C. to 150° C. from the viewpoint of fixability, storage stability, and durability.

The glass transition temperature of the polyester resin is preferably 45° C. to 75° C., more preferably 50° C. to 75° C., and still more preferably 50° C. to 70° C. from the viewpoint of fixability, storage stability, and durability.

The acid value of the polyester resin is preferably 1 mg KOH/g to 80 mgKOH/g, more preferably 5 mgKOH/g to 60 mgKOH/g, and still more preferably 5 mgKOH/g to 50 mgKOH/g from the viewpoint of chargeability and environmental stability.

The hydroxyl value of the polyester resin is preferably 1 mgKOH/g to 80 mgKOH/g, more preferably 8 mgKOH/g to 50 mgKOH/g, and still more preferably 8 mgKOH/g to 40 mgKOH/g from the viewpoint of chargeability and environmental stability.

From the viewpoint of low-temperature fixability and storage stability, the amount of the low-molecular weight components having a weight average molecular weight of 500 or less, which is attributable to residual monomer components and oligomer components, contained in the polyester resin is preferably 12% or less, more preferably 10% or less, still more preferably 9% or less, and particularly preferably 8% or less. The amount of the low-molecular weight components contained in the polyester resin can be reduced, for example, by increasing the (meth)acrylic acid-modification degree of the rosin.

The polyester resin may be a polyester resin which is modified within such a range that the properties thereof are not substantially impaired. The term "modified polyester resin" means a polyester resin which is grafted or blocked with phenol, urethane, epoxy or the like by a method described, for example, in Japanese Patent Application Laid-Open (JP-A) Nos. 11-133668, 10-239903, 8-20636, etc.

In the present invention, by use of the above-mentioned polyester resin as a binder resin for toner, it is possible to obtain a toner which is superior in low-temperature fixability, storage stability as well as in durability and is capable of reducing odor during fixing.

In the toner, conventionally known binder resin(s), for example, a vinyl resin such as a styrene-acrylic resin; and other resins such as an epoxy resin, a polycarbonate resin, and a polyurethane resin, may be additionally used, however, the amount of the polyester resin contained in the binder resin is preferably 70% by mass or more, more preferably 80% by mass or more, still more preferably 90% by mass or more, and particularly preferably 100% by mass.

—Colorant—

The colorant is not particularly limited and may be suitably selected from among conventionally known dyes and pigments in accordance with the intended use. Examples thereof include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. These colorants may be used alone or in combination.

The color of the colorant is not particularly limited and may be suitably selected in accordance with the intended use. For example, black pigments and color pigments are exemplified. These colors may be used alone or in combination.

Examples of black pigments include carbon blacks (C.I. Pigment Black 7) such as furnace carbon black, lamp black, acetylene black, and channel black; metals such as copper, iron (C.I. Pigment Black 11), and titanium oxides; and organic pigments such as aniline black (C. I. Pigment Black 1).

Examples of magenta color pigments include C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C. I. Pigment Violet 19; C. I. Vat Red 1, 2, 10, 13, 15, 23, 29, and 35.

Examples of cyan color pigments include C. I. Pigment Blue 2, 3, 15, 15:1, 15:2, 15:3, 15:4, 15:6, 16, 17, and 60; C. I. Vat Blue 6; C. I. Acid Blue 45 or copper phthalocyanine pigment whose phthalocyanine skeleton is substituted with 1 to 5 phthalimide methyl groups, C. I. Pigment Green 7, and C. I. Pigment Green 36.

Examples of yellow color pigment include C. I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, and 180; C. I. Vat Yellow 1, 3, and 20, C. I. Orange 36.

The amount of the colorant contained in the toner is not particularly limited and may be suitably selected in accordance with the intended use, however, it is preferably 1% by mass to 15% by mass, and more preferably 3% by mass to 10% by mass. When the colorant content is less than 1% by mass, a decrease in the tinting strength of the resulting toner is observed. When it is more than 15% by mass, dispersion failure of the pigment occurs in the toner, which may lead to a decrease in the tinting strength and a degradation in electric properties of the toner.

These colorants may be used as a masterbatch obtained by combining with a resin. The resin is not particularly limited and may be suitably selected from among conventionally known resins. Examples thereof include styrenes or polymers of substituted styrenes, styrene copolymers, polymethyl methacrylate resins, polybutyl methacrylate resins, polyvinyl chloride resins, polyvinyl acetate resins, polyethylene resins, polypropylene resins, polyester resins, epoxy resins, epoxy polyol resins, polyurethane resins, polyamide resins, polyvinyl butyral resins, polyacrylic acid resins, rosins, modified rosins, terpene resins, aliphatic hydrocarbon resins, alicyclic hydrocarbon resins, aromatic petroleum resins, chlorinated paraffins, and paraffins. These may be used alone or in combination.

Examples of the styrenes or polymers of substituted styrenes include polyester resins, polystyrene resins, poly(p-chlorostyrene) resins, and polyvinyl toluene resins. Examples of the styrene copolymers include styrene-p-chlorostyrene copolymers, styrene-propylene copolymers, styrene-vinyltoluene copolymers, styrene-vinylnaphthaline copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers.

The masterbatch can be obtained by mixing and kneading the resin for masterbatch and the colorant under application of high shear force. On that occasion, it is preferable to use an organic solvent to enhance the interaction between the colorant and the resin. A so-called flashing method, where an aqueous paste containing colorant water is mixed and kneaded with a resin and an organic solvent to transfer the colorant to the resin, and water content and organic solvent component are removed, may also be preferably used because a wet cake of the colorant may be directly used without drying the cake. For the mixing and kneading, a high-shearing dispersion apparatus such as a triple roll mill is preferably used.

—Releasing Agent—

The releasing agent is not particularly limited and may be suitably selected from among conventionally known releasing agents in accordance with the intended use. For example, waxes such as carbonyl group-containing waxes, polyolefin waxes, and long-chain hydrocarbon waxes are exemplified. These waxes may be used alone or in combination. Among them, carbonyl group-containing waxes are preferred.

Examples of the carbonyl group-containing waxes include polyalkanoic acid ester, polyalkanol ester, polyalkanoic acid amide, and polyalkyl amide, and dialkyl ketone. Examples of the polyalkanoic acid ester include carnauba wax, montan wax, trimethylolpropane tribehenate, pentaerythritol tetrabehenate, pentaerythritol diacetate dibehenate, glycerin tribehenate, and 1,18-octadekane diol distearate. Examples of the polyalkanol ester include trimellitic acid tristearyl, and distearyl maleate. Examples of the polyalkanoic acid amide include dibehenyl amide. Examples of the polyalkyl amide include trimellitic acid tristearyl amide. Examples of the dialkyl ketone include distearyl ketone. Of these carbonyl group-containing waxes, polyalkanoic acid ester is particularly preferred.

Examples of the polyolefin waxes include polyethylene waxes, and polypropylene waxes.

Examples of the long-chain hydrocarbon waxes include paraffin waxes, and SAZOL waxes.

The melting point of the releasing agent is not particularly limited and may be suitably selected in accordance with the intended use, however, it is preferably 40° C. to 160° C., more preferably 50° C. to 120° C., and particularly preferably 60° C. to 90° C. When the melting point is lower than 40° C., it may adversely affect the heat resistance/storage stability. When it is higher than 160° C., cold offset tends to be caused in low-temperature fixing.

The melt viscosity of the releasing agent is, as a value measured at 20° C. higher than the melting point of the wax, preferably 5 cps to 1,000 cps, and more preferably 10 cps to 100 cps. When the melt viscosity is lower than 5 cps, the releasing properties may degrade. When it is higher than 1,000 cps, the effect of improving the hot-offset resistance and the low-temperature fixability may not be obtained.

The amount of the releasing agent contained in the toner is not particularly limited and may be suitably adjusted in accordance with the intended use, however, it is preferably 40% by mass or less, and more preferably 3% by mass to 30% by mass. When the releasing agent content is more than 40% by mass, the flowability of the resulting toner may degrade.

—Charge-controlling Agent—

The charge controlling agent is not particularly limited and may be suitably selected from among conventionally known charge controlling agents in accordance with the intended use. However, when a colored material is used, the color tone of the resulting toner may be changed, and thus it is preferable to use a colorless material and/or a material close to white color is preferred. For example, triphenylmethane dyes, molybdic acid chelate pigments, Rhodamine dyes, alkoxy-based amines, quaternary ammonium salts (including fluorine-modified quaternary ammonium salts), alkylamide, a single substance or compound of phosphorus, a single substance or compound of tungsten, fluorine-based active agents, metal salts of salicylic acid, and metal salts of salicylic acid derivatives are exemplified. These charge controlling agents may be used alone or in combination.

The charge controlling agent may be a commercially available product. Examples of the commercially available product include BONTRON P-51 (quaternary ammonium salt), BONTRON E-82 (oxynaphthoic acid metal complex), E-84 (salicylic acid metal complex), and E-89 (phenolic condensate), which are produced by Orient Chemical Industries, Ltd.; TP-302 and TP415 (quaternary ammonium salt molybdenum complexes), which are produced by Hodogaya Chemical Co., LTD.; COPY CHARGE PSY VP2038 (quaternary ammonium salt), COPY BLUE PR (triphenylmethane derivative), COPY CHARGE NEG VP2036 and COPY CHARGE NX VP434 (quaternary ammonium salts), which are produced by Hoechst AG; LRA-901, and LR-147 (boron complexes), which are produced by Japan Carlit Co., Ltd.; quinacridones, azo pigments; and polymer compounds having a functional group such as sulfonic acid group, carboxyl group, and quaternary ammonium salt.

The charge controlling agent may be fused and kneaded along with the masterbatch, and then dissolved and/or dispersed, or may be directly added, together with the above-mentioned components of toner, into the organic solvent, when the components are dissolved and/or dispersed in the solvent, or may be fixed on surfaces of toner particles after the toner particles are produced.

The amount of the charge controlling agent contained in the toner varies depending on the type of the binder resin, presence or absence of additives, the dispersing method, and the like, and cannot be unequivocally defined. However, for example, it is preferably 0.1 parts by mass to 10 parts by mass, and more preferably 0.2 parts by mass to 5 parts by mass relative to 100 parts by mass of the binder resin. When the charge controlling agent content is less than 0.1 parts by mass, the charge controllability may not be obtained. When it is more than 10 parts by mass, the chargeability of the resulting toner is excessively increased to reduce the effect of the main charge controlling agent and to increase the electrostatic attraction force with a developing roller used, possibly leading to a degradation in flowability of the developer and a degradation in image density.

—External Additives—

The external additives are not particularly limited and may be suitably selected from among conventionally known external additives in accordance with the intended use. Examples thereof include silica fine particles, hydrophobically treated silica fine particles, fatty acid metal salts (e.g. zinc stearate, and aluminum stearate); metal oxides (e.g. titania, alumina, tin oxides, and antimony oxides); or hydrophobically treated products thereof, and fluoropolymers. Of these, hydrophobically treated silica fine particles, titania particles, and hydrophobically treated titania fine particles are preferred.

Examples of the silica fine particles include HDK H 2000, HDK H 2000/4, HDK H 2050EP, HVK21, and HDK H1303 (all produced by Hoechst AG); and R972, R974, RX200, RY200, R202, R805, and R812 (all produced by Japan AEROSIL Inc.). Examples of the titania fine particles include P-25 (produced by Japan AEROSIL Inc.); STT-30, and STT-65C-S (both produced by Titan Kogyo Ltd.); TAF-140 (produced by Fuji Titanium Industry Co., Ltd.); and MT-150W, MT-500B, MT-600B, and MT-150A (all produced by TAYCA CORPORATION). Examples of the hydrophobically treated titanium oxide fine particles include T-805 (produced by Japan AEROSIL Inc.); STT-30A, and STT-65S-S (both produced by Titan Kogyo Ltd.); TAF-500T, TAF-1500T (both produced by Fuji Titanium Industry Co., Ltd.); MT-100S, and MT-100T (both produced by TAYCA CORPORATION); and IT-S (produced by ISHIHARA SANGYO KAISHA LTD.).

The hydrophobically treated silica fine particles, hydrophobically treated titania fine particles or hydrophobically treated alumina fine particles can be obtained by treating hydrophilic fine particles with a silane coupling agent such as methyl trimethoxy silane, methyl triethoxy silane, and octyl trimethoxy silane.

As a hydrophobizing agent used in the treatment, for example, silane coupling agents such as dialkyl dihalogenated silane, trialkyl halogenated silane, alkyl trihalogenated silane, and hexaalkyl silazane; silylation agents; silane coupling agents having an alkyl fluoride group; organic titanate coupling agents; aluminum coupling agents; silicone oil, and silicone varnish are exemplified.

Alternatively, silicone oil-treated inorganic fine particles are also preferably used, which are obtained by treating inorganic fine particles with silicone oil under heating as necessary.

Specific examples of the inorganic fine particles include silica, alumina, titanium oxide, barium titanate, magnesium titanate, calcium titanate, strontium titanate, iron oxide, copper oxide, zinc oxide, tin oxide, silica sand, clay, mica, wollastonite, diatom earth, chromium oxide, cerium oxide, colcothar, antimony trioxide, magnesium oxide, zirconium oxide, barium sulfate, barium carbonate, calcium carbonate, silicon carbide, and silicon nitride. Of these, silica and titanium dioxide are particularly preferred.

Specific examples of the silicone oil include dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl-modified silicone oil, methacryl-modified silicone oil, and α-methylstyrene-modified silicone oil.

The average primary particle diameter of the inorganic fine particles is preferably 1 nm to 100 nm, and more preferably 3 nm to 70 nm. When the average primary particle diameter is smaller than 1 nm, the inorganic fine particles are embedded in the surface of toner particles, and the function thereof may not be effectively exerted. When it is greater than 100 nm, a surface of the latent electrostatic image bearing member may be unevenly damaged. As the external additives, inorganic fine particles and hydrophobically treated inorganic fine particles may be additionally used. The average particle diameter of hydrophobically treated primary particles is preferably 1 nm to 100 nm, and more preferably 5 nm to 70 nm. Preferably, the inorganic fine particles contain at least two types of inorganic fine particles whose average particle diameter of hydrophobically treated primary particles is 20 nm or smaller. More preferably, the inorganic fine particles further contain at least one type of inorganic fine particles whose average particle diameter of hydrophobically treated primary particles is 30 nm or greater. Further, the specific surface area of the inorganic fine particles measured by BET method is preferably 20 $m^2/g$ to 500 $m^2/g$.

The amount of the external additives added to the toner is preferably 0.1% by mass to 5% by mass, and more preferably 0.3% by mass to 3% by mass.

As the external additives, resin fine particles may also be added. As the resin fine particles, for example, polystyrene obtained by soap-free emulsification polymerization, suspension polymerization or dispersion polymerization; copolymers of methacrylic acid ester, copolymers of acrylic acid ester; polycondensates such as silicone, benzoguanamine, and nylon; and polymeric particles of thermosetting resins are exemplified. By additionally using such resin fine particles, it is possible to increase the chargeability of the resulting tone and to reduce the amount of inversely charged toner, and consequently, it is possible to reduce the occurrence of background smear. The amount of the resin fine particle added to the toner is preferably 0.01% by mass to 5% by mass, and more preferably 0.1% by mass to 2% by mass.

—Other Components—

The other components are not particularly limited and may be suitably selected in accordance with the intended use. For example, flowability improving agents, cleanability improving agents, magnetic materials, metal soaps are exemplified.

The flowability improving agent is used in surface treatment of the resulting toner to increase the hydrophobicity of the toner and is capable of preventing degradation in the flowability and chargeability of the toner even under high-humidity conditions. Examples of the flowability improving agent include silane coupling agents, silylation agents, silane coupling agents having an alkyl fluoride group, organic titanate coupling agents, and aluminum coupling agents, and silicone oil, and modified silicone oil.

The cleanability improving agent is added into the toner so as to remove untransferred developer which is remaining on a latent electrostatic image bearing member and an intermediate transfer member. Examples of the cleanability improving agent include fatty acid metal salts such as zinc stearate, calcium stearate, and stearic acids; and polymer fine particles such as polystyrene fine particles produced by soap-free emulsification polymerization. As the polymer fine particles, those having a relatively narrow particle size distribution are preferable, and those further having a volume average particle diameter of 0.01 μm to 1 μm are suitably used.

The magnetic material is not particularly limited and may be suitably selected from among conventionally known magnetic materials. Examples thereof include iron powder, magnetite powder, and ferrite powder. Of these, in terms of color tone, white color powders are preferable.

—Toner Production Method—

The toner production method is not particularly limited and may be suitably selected from conventionally known methods. For instance, kneading-pulverization method, polymerization method, dissolution-suspension method, spray-granulation method, and the like are exemplified.

—Kneading-Pulverization Method—

The kneading-pulverization method is a method to produce base particles of the toner, for example, by melt-kneading toner materials containing at least a binder resin, and a colorant to obtain a kneaded product, pulverizing the obtained kneaded product, and then subjecting to classification.

In the melt-kneading, the toner materials are mixed, and the resulting mixture is placed in a melt-kneader so as to be melt and kneaded. As the melt-kneader, for example, a uniaxial or biaxial continuous kneader, and a batch type kneader with a roll mill can be used. For example, KTK type biaxial extruder manufactured by KOBE STEEL., LTD.; TEM type biaxial extruder manufactured by TOSHIBA MACHINE CO., LTD.; biaxial extruder manufactured by KCK Co., Ltd.; PCM type biaxial extruder manufactured by IKEGAI, LTD and co-kneader manufactured by BUSS Inc. are preferably used. It is preferable that the melt-kneading be carried out under such appropriate conditions that do not cause cutting-off of molecular chains of the binder resin. Specifically, the melt-kneading temperature is set in reference to the softening point of the binder resin. When the melting kneading temperature is excessively higher than the softening point, the molecular chains of the binder resin are severely cut off, and when excessively lower than the softening point, the dispersion of the toner material may not proceed.

In the pulverization, the kneaded product obtained in the kneading is pulverized. In the pulverization, it is preferred that first the kneaded product be coarsely crushed and then finely pulverized. It is also preferred that the toner material mixture be pulverized by making particles collide with a collision plate or making particles collide with each other in a jet stream or pulverizing the toner mixture particles in a narrow gap between a mechanically rotatable rotor and a stator.

In the classification of particles, the pulverized material obtained in the pulverization is classified to prepare particles having predetermined particle diameters. The classification can be carried out by removing fine particles using, for example, a cyclone, a decanter, a centrifugal separator or the like.

After completion of the pulverization and classification, the pulverized material is classified in a stream by applying a centrifugal force thereto, thereby producing toner base particles having predetermined particle diameters.

Next, external additives are externally added to the toner base particles. By mixing and stirring the toner base particles and the external additives using a mixer, the toner base particle surfaces are coated with the external additives with the external additive being dissolved and pulverized. Here, it is important to make the external additives such as inorganic fine particles, resin fine particles and the like uniformly and strongly adhere on surfaces of the toner base particles, in terms of the durability of the toner.

—Polymerization Method—

In the toner production method based on the polymerization method, for example, toner materials containing at least a modified polyester resin that can form a urea bonding or urethane bonding and a colorant are dissolved and/or dispersed in an organic solvent, the dissolved and/or dispersed material is dispersed in an aqueous medium so as to be subjected to a polymerization addition reaction, and the solvent of the dispersion liquid is removed, followed by washing, thereby obtaining a toner.

As for the modified polyester resin that can form a urea bonding or urethane bonding, a polyester prepolymer having an isocyanate group in which a carboxyl group, a hydroxyl group or the like is reacted with a polyvalent isocyanate compound (PIC) is exemplified. A modified polyester resin that can be obtained by crosslinking and/or elongating the molecular chains in a reaction between the polyester prepolymer and amines or the like can improve the hot offset resistance of the toner while maintaining the low-temperature fixability.

Examples of the polyvalent isocyanate compound (PIC) include aliphatic polyvalent isocyanates (such as tetramethylene diisocyanate, hexamethylene diisocyanate, and 2,6-diisocyanate methyl caproate); cycloaliphatic polyisocyanates (such as isophorone diisocyanate, and cyclohexyl methane diisocyanate); aromatic diisocyanates (such as tolylene diisocyanate, and diphenyl methane diisocyanate); aromatic aliphatic diisocyanates (α,α,α',α'-tetramethyl xylene diisocyanate, etc.); isocyanates; and the polyisocyanates blocked with a phenol derivative, oxime, caprolactam or the like. These may be used alone or in combination.

The mixing ratio of the polyvalent isocyanate compound (PIC), as an equivalent ratio [NCO]/[OH] of isocyanate group [NCO] content in the polyisocyanate (PIC) to hydroxyl group [OH] content in the hydroxyl group-containing polyester, is preferably 5/1 to 1/1, more preferably 4/1 to 1.2/1, and still more preferably 2.5/1 to 1.5/1.

The number of isocyanate groups contained in one molecule of the polyester prepolymer (A) having an isocyanate group is preferably one or more, more preferably 1.5 to 3 on the average, and still more preferably 1.8 to 2.5 on the average.

Examples of the amines (B) to be reacted with the polyester prepolymer include divalent amine compounds (B1), trivalent or higher polyvalent amine compounds (B2), amino alcohols (B3), aminomercaptans (B4), amino acids (B5) and blocked amines of which amino groups of B1 to B5 are blocked (B6).

Examples of the divalent amine compounds (B1) include aromatic diamines (such as phenylene diamine, diethyl toluene diamine, and 4,4'-diaminodiphenyl methane); cycloaliphatic diamines (such as 4,4'-diamino-3,3'-dimethyldicyclohexylmethane, diamine cyclohexane, and isophorone diamine); and aliphatic amines (such as ethylene diamine, tetramethylene diamine, and hexamethylene diamine).

Examples of the trivalent or higher polyvalent amine compounds (B2) include diethylene triamine, and triethylene tetramine.

Examples of the amino alcohols (B3) include ethanol amine, and hydroxyethyl aniline.

Examples of the aminomercaptans (B4) include aminoethyl mercaptan, and aminopropyl mercaptan.

Examples of the amino acids (B5) include amino propionate, and amino caproate.

Examples of the blocked amines of which amino groups of B1 to B5 are blocked (B6) include ketimine compounds obtainable from the amines of B1 to B5 and ketones (such as acetone, methylethylketone, and methylisobutylketone), and oxazolidine compounds. Of these amines (B), a mixture of amines of B1 and B1 and a small amount of amine B2 is particularly preferable.

The mixing ratio of the amines (B), as an equivalent ratio of [NCO]/[NHx] of isocyanate group [NCO] content in the polyester prepolymer (A) having an isocyanate group to amino group [NHx] content in the amines (B), is preferably 1/2 to 2/1, more preferably 1.5/1 to 1/1.5, and still more preferably 1.2/1 to 1/1.2.

According to a toner production method based on the polymerization method stated above, it is possible to produce a spherically shaped toner having small particle diameter at a low cost without having a significant impact on the surrounding environment.

Color of the toner is not particularly limited and may be suitably selected in accordance with the intended use. For example, at least one selected from black toners, cyan toners, magenta toners and yellow toners can be used. Each color of toners can be selected by suitably selecting the types of the colorants, and is preferably a colored toner.

—Physical Properties of Toner—

The volume average particle diameter (Dv) of the toner is preferably, for example, 3 μm to 8 μm, and more preferably 4 μm to 7 μm. Note that the volume average particle diameter is defined by the equation, $Dv=[(\Sigma(nD^3)/\Sigma n)^{1/3}$. In the equation, n is the number of particles, and D is a particle diameter.

When the volume average particle diameter (Dv) of the toner is smaller than 3 μm, the toner contained in a two-component developer may be fused onto the surface of carrier during long-term agitation in the developing device, possibly leading to degradation of the chargeability of the carrier. In the case of a one-component developer, toner filming onto the developing rollers and toner fusion onto members, such as a blade for making the toner layers thinner, may easily occur. When the volume average particle diameter (Dv) of the toner is greater than 8 μm, it becomes difficult to obtain a high-quality image at high resolution, and in the process of inflow/outflow of the toner in the developer, the particle diameter of the toner may largely vary.

The volume average particle diameter, and a ratio (Dv/Dn) of the volume average particle diameter (Dv) to the number average particle diameter (Dn) can be measured using a particle size measurement device, for example, MULTISIZER II manufactured by Beckman Coulter Co.

The toner of the present invention has a concentration of radioactive carbon isotope $^{14}C$ of 10.8 pMC or higher, and makes a significant contribution to biomass production and can meet a desired image quality, and thus it can be preferably used in a variety of fields, more preferably used in electrophotographic image formation, and particularly preferably used in toner containers, developers, process cartridges, image forming apparatuses, and image forming methods.

(Developer)

The developer of the present invention contains the toner according to the present invention and may contain other arbitrarily selected components such as carrier. Therefore, the developer is superior in transferability, chargeability, etc. and is capable of stably forming a high-quality image. The developer may be a one-component developer or two-component developer. When used in a high-speed printer, etc., whose performance is improved in response to recent higher information processing speed, it is preferable to use a two-component developer because the life-span is prolonged.

When the developer is used as a two-component developer, the toner will be used after being mixed with a magnetic carrier. As for the ratio of the toner to the carrier contained in the developer, preferably, 1 part by mass to 10 parts by mass of the toner is contained relative to 100 parts by mass of the carrier.

Examples of the magnetic carrier include iron powder, ferrite powder and magnetite powder each having a particle diameter of about 20 μm to 200 μm, and a coated carrier containing a magnetic carrier as the core whose surface is coated with a resin. Of these, coated carrier is particularly preferable.

Examples of the resin used to coat the surface of the carrier include urea-formaldehyde resins, melamine resins, benzoguanamine resins, urea resins, polyamide resins, epoxy resins, polyvinyl resins, polyvinylidene resins, acrylic resins, polymethyl methacrylate resins, polyacrylonitrile resins, polyvinyl acetate resins, polyvinyl alcohol resins, polyvinyl butyral resins, polystyrene resins, styrene-acrylic copolymer resins, polyvinyl chloride resins, polyethylene terephthalate resins, polybutylene terephthalate resins, polycarbonate resins, polyethylene resins, polyvinyl fluoride resins, polyvinylidene fluoride resins, polytrifluoroethylene resins, polyhexafluoropropylene resins, copolymers of vinylidene fluoride with acrylic monomer, copolymers of vinylidene fluoride with vinyl fluoride, fluoroterpolymers such as terpolymer of tetrafluoroethylene, vinylidene fluoride and non-fluoride monomer, and silicone resins.

As necessary, electrically conductive powder or the like may be contained in the resin for coating. As the electrically conductive powder, metal powder, carbon black, titanium oxide, tin oxide, zinc oxide, or the like can be used. The electrically conductive powder preferably has an average particle diameter of 1 μm or smaller. When the average particle diameter is greater than 1 μm, it is difficult to control the electric resistance.

<Toner Container>

The toner container houses the toner according to the present invention. Note that the toner container may house the developer according to the present invention.

The container of the toner container may be suitably selected from among conventionally known containers. Those having a container main body and a cap are preferably used.

The toner container main body is not particularly limited as to the size, shape, structure, material, and the like, and may be suitably selected in accordance with the intended use. The container main body preferably has a cylindrical shape having spiral projections and depressions on the inner surface thereof, with a part of the spiral portion or the whole thereof having an accordion function. In such a toner container, a toner contained therein can be moved toward the outlet by rotating the toner container.

Material of the toner container main body is not particularly limited. A material that is formable with excellent dimensional precision is preferable. Preferred are resins such as polyester resins, polyethylene resins, polypropylene resins, polystyrene resins, polyvinyl chloride resins, polyacrylic resins, polycarbonate resins, ABS resins, and polyacetal resins.

The toner container allows for easy storage and easy transportation, is excellent in handleability, detachably mounted to a process cartridge and an image forming apparatus, etc. for supply of toner.

<Process Cartridge>

The process cartridge includes at least a latent electrostatic image bearing member that bears, on its surface, a latent electrostatic image, and a developing unit configured to develop the latent electrostatic image borne on the latent electrostatic image bearing member using a developer, and further includes other units suitably selected in accordance with the necessity.

The developing unit includes at least a developer container for housing the toner and/or developer of the present invention, and a developer bearing member that bears and conveys the toner and/or developer housed in the developer container, and may further include a layer thickness regulating member for regulating the thickness of a toner layer to be borne on the developer bearing member, and other members.

The process cartridge is detachably mounted on main bodies of various electrophotographic image forming apparatuses, and is preferably detachably mounted on a main body of the after-mentioned image forming apparatus of the present invention.

The process cartridge, as shown in FIG. 1, for example, incorporates a latent electrostatic image bearing member 101, includes a charging unit 102, a developing unit 104, a transfer unit 108 and a cleaning unit 107, and further includes other units in accordance with the necessity. In FIG. 1, a reference numeral 103 denotes light exposure from an exposing unit, and a reference numeral 105 denotes a recording medium.

Next, the following explains an image forming process using the process cartridge in FIG. 1. While a latent electrostatic image bearing member is rotating in a direction indicated by the arrow, it is charged by the charging unit 102 and exposed to light 103 by an exposing unit (not shown) to form, on its surface, a latent electrostatic image corresponding to an exposed image. The electrostatic image is developed by the developing unit 104 to form a visible image, the resulting visible image is transferred onto the recording medium 105 by means of the transfer unit 108 so as to be printed out. Next, the surface of the latent electrostatic image bearing member 101 is subjected to cleaning by the cleaning unit 107 and further subjected to charge elimination by a charge eliminating unit (not shown). The above-mentioned operation is repeatedly carried out.

(Image Forming Method and Image Forming Apparatus)

The image forming method of the present invention includes at least a latent electrostatic image forming step, a developing step, a transferring step and a fixing step, and further includes other steps suitably selected in accordance with the necessity, for example, a charge eliminating step, a cleaning step, a recycling step, a controlling step, etc.

The image forming apparatus of the present invention includes at least a latent electrostatic image bearing member, a latent electrostatic image forming unit, a developing unit, a transfer unit and a fixing unit, and further includes other units suitably selected in accordance with the necessity, for example, a charge eliminating unit, a cleaning unit, a recycling unit, a controlling unit, etc.

The latent electrostatic image forming step is a step of forming a latent electrostatic image on a latent electrostatic image bearing member.

The material, shape, structure, size, and the like of the latent electrostatic image bearing member (otherwise, referred to as "electrophotographic photoconductor", "photoconductor" or "image bearing member") are not particularly limited and may be suitably selected in accordance with the intended use. As to the shape, a drum-shape is preferred. As to the material, for example, inorganic photoconductors such as amorphous silicon, and selenium; and organic photoconductors such as polysilane, and phthalopolymethine are preferably exemplified. Of these materials, amorphous silicon and the like are preferable in terms of longer life.

The formation of a latent electrostatic image can be carried out, for example, by uniformly charging a surface of the latent electrostatic image bearing member and exposing imagewise a photosensitive layer of the latent electrostatic image bearing member, by means of the latent electrostatic image forming unit. The latent electrostatic image forming unit is equipped with, for example, at least a charger that uniformly charges a surface of the latent electrostatic image bearing member and an exposure device that exposes imagewise the surface of the latent electrostatic image bearing member.

The charging can be carried out, for example, by applying a voltage to the surface of the latent electrostatic image bearing member, using the charger.

The charger is not particularly limited and may be suitably selected in accordance with the intended use. Examples of the charger include conventionally known non-contact chargers utilizing corona discharge such as corotron, and scorotron, which are provided with a conductive or semiconductive roller, brush, rubber blade, or the like.

The exposure of the latent electrostatic image baring member to light can be carried out, for example, by exposing imagewise a surface of the latent electrostatic image bearing member using the exposure device.

The exposure device is not particularly limited as long as it can expose imagewise a surface of the latent electrostatic image bearing member that has been charged by the charger, and may be suitably selected in accordance with the intended use. For example, there are various types of exposure device such as rod-lens array systems, optical laser systems, optical liquid crystal shutter systems, and LED optical systems.

Note that in the present invention, a backlight system may be employed for the exposure, in which the electrophotographic photoconductor is imagewise-exposed from the back side thereof.

—Developing Step and Developing Unit—

The developing step is a step of exposing the latent electrostatic image using the toner and/or developer of the present invention to forma a visible image.

The formation of the visible image can be carried out, for example, by developing the latent electrostatic image using the toner and/or developer of the present invention by means of the developing unit.

The developing unit is not particularly limited as long as it can develop a visible image using the toner and/or developer of the present invention, and may be suitably selected from among conventionally known developing units. Preferred is a developing unit having at least functions of housing the toner and/or developer of the present invention and supplying the toner and/or developer to the latent electrostatic image in a contact or non-contact manner. More preferred is a developing unit equipped with the toner container described above.

The developing device may employ a dry-process developing system or wet-process developing system, and may be a developing device for monochrome or multi-color image. Preferred is, for example, a developing device having a stirrer capable of frictionally stirring the toner and/or developer so as to be charged, and a rotatable magnet roller.

In the developing device, for example, the toner and the carrier are mixed and stirred, and the toner is charged by the resulting friction and kept raised on the surface of a rotating magnet roller, forming a magnetic brush. Since the magnetic roller is placed near the latent electrostatic image bearing member (photoconductor), a part of the toner constituting the magnetic brush formed on the magnetic roller surface moves onto the surface of the latent electrostatic image bearing member (photoconductor) by electric attraction force. As a result, the latent electrostatic image is developed with the toner to form a visible image formed of the toner on the surface of the latent electrostatic image bearing member (photoconductor).

A developer to be housed in the developing device includes the toner of the present invention. The developer may be a one-component developer or two-component developer as long as it contains the toner of the present invention.

—Transferring Step and Transfer Unit—

The transferring step is a step of transferring the visible image onto a recording medium. In a preferred embodiment, an intermediate transfer member is used, a visible image is primarily transferred onto the intermediate transfer member and then the visible image is secondarily transferred onto a recording medium. In a more preferred embodiment, as the toner, at least two colors, more preferably a set of full-color toners is used, a visible image is primarily transferred to an intermediate transfer member to form a composite transfer image, and the composite transfer image is secondarily transferred onto a recording medium.

The transfer process can be carried out, for example, by charging the visible image formed on the latent electrostatic image bearing member (photoconductor) by means of a transfer charger as the transfer unit. A preferred embodiment of the transfer unit has a primary transfer unit configured to primarily transfer a visible image onto an intermediate transfer member to form a composite transfer image, and a secondary transfer unit configured to secondarily transfer the composite transfer image onto a recording medium.

The intermediate transfer member is not particularly limited and may be suitably selected from among conventionally known transfer devices. For example, preferred is a transfer belt or the like.

It is preferable that the transfer units (the primary transfer unit and the secondary transfer unit) be provided at least with a transfer device for peeling the visible image formed on the latent electrostatic image bearing member (photoconductor) and charging it to move toward the recording medium. The transfer unit may be provided in one unit or two or more units.

Examples of the transfer unit include a corona transfer device based on corona discharge, a transfer belt, a transfer roller, a pressure transfer roller, and an adhesive transfer device.

The recording medium is not particularly limited and may be suitably selected from among conventionally known recording media (recording paper).

The fixing step is a step of fixing the transferred visible image on a recording medium by means of a fixing device. This step may be carried out for every transfer of individual color toners to the recording medium or carried out at a time in a state where individual color toners are stacked on one another.

The fixing device is not particularly limited and may be suitably selected in accordance with the intended use. Preferred is, for example, a heating/pressure unit. Examples of the heating/pressure unit includes a combination of a heating roller with a pressure roller and a combination of a heating roller, a pressure roller and an endless belt.

Preferably, heating by the heating/pressure unit is usually from 80° C. to 200° C.

Note that in the present invention, any known optical fixing device may be used together with a fixing step and a fixing unit or in place of them, depending on the purpose.

The charge eliminating step is a step of applying an antistatic bias to the latent electrostatic image bearing member to eliminate charge and can be favorably carried out by the charge eliminating unit.

The charge eliminating unit is not particularly limited as long as it can apply an antistatic bias to the latent electrostatic image bearing member, and may be suitably selected among from conventionally known charge eliminating devices. Preferred is a charge eliminating lamp.

The cleaning step is a step of removing the toner remaining on the latent electrostatic image bearing member and preferably carried out by the cleaning unit.

The cleaning unit is not particularly limited, as long as it can remove the electrophotographic toner remaining on the latent electrostatic image bearing member, and may be suitably selected from among known cleaners. Preferred examples thereof include magnetic brush cleaners, electrostatic brush cleaners, magnetic roller cleaners, blade cleaners, brush cleaners, and web cleaners.

The recycling step is a step of recycling the toner that has been removed by the cleaning step to the developing unit, and is suitably carried out by a recycling unit. The recycling unit is not particularly limited. Examples thereof include known conveyance units.

The controlling step is a step of controlling each of the above-mentioned steps, and is suitably carried out by a controlling unit.

The controlling unit is not particularly limited, as long as being capable of controlling the performance of each unit, and may be suitably selected in accordance with the intended use. Examples thereof include equipment such as sequencers, and computers.

Hereinafter, one embodiment of the image forming method of the present invention by means of the image forming apparatus will be described with reference to FIG. 2. An image forming apparatus 100 shown in FIG. 2 is provided with a photoconductor drum 10 as the latent electrostatic image bearing member, a charging roller 20 as the charging unit, an exposure device 30 as the exposing unit, a developing device 40 as the developing unit, an intermediate transfer member 50, a cleaning device 60 having a cleaning blade, as the cleaning unit, and a charge eliminating lamp 70 as the charge eliminating unit.

The intermediate transfer member 50 is an endless belt and is designed to be spanned over three rollers 51 disposed inside thereof and to be rotatable in the direction indicated by the arrow in the figure by means of the three rollers 51. One or more of the three rollers 51 also functions as a transfer bias roller capable of applying a certain transfer bias or a primary transfer bias to the intermediate transfer member 50. A cleaning blade 90 is provided adjacent to the intermediate transfer member 50. There is provided a transferring roller 80 as the transfer unit is capable of applying a transfer bias at a position to face the intermediate transfer member 50 so as to secondarily transfer a visible image (toner image) to a recording medium 95. Further, there is provided a corona charger 58 in the periphery of the intermediate transfer member 50 for applying charges to the toner image transferred on the intermediate transferring medium 50. The corona charger 58 is placed between the contact region of the latent electrostatic image bearing member 10 and the intermediate transferring medium 50 and the contact region of the intermediate transfer member 50 and the recording medium 95 in the rotational direction of the intermediate transfer member 50.

The developing device 40 is composed of a developing belt 41 as a developer bearing member, a black developing unit 45K, a yellow developing unit 45Y, a magenta developing unit 45M and a cyan developing unit 45C, the developing units being positioned around the developing belt 41. The black developing unit 45K is equipped with a developer container 42K, a developer supplying roller 43K, and a developing roller 44K. The yellow developing unit 45Y is equipped with a developer container 42Y, a developer supplying roller 43Y, and a developing roller 44Y. The magenta developing unit 45M is equipped with a developer container 42M, a developer supplying roller 43M, and a developing roller 44M. The cyan developing unit 45C is equipped with a developer container 42C, a developer supplying roller 43C, and a developing roller 44C. The developing belt 41 is an endless belt that is spanned over a plurality of belt rollers so as to be rotatable. A part of the developing belt 41 is in contact with the latent electrostatic image bearing member 10.

Figure 2:
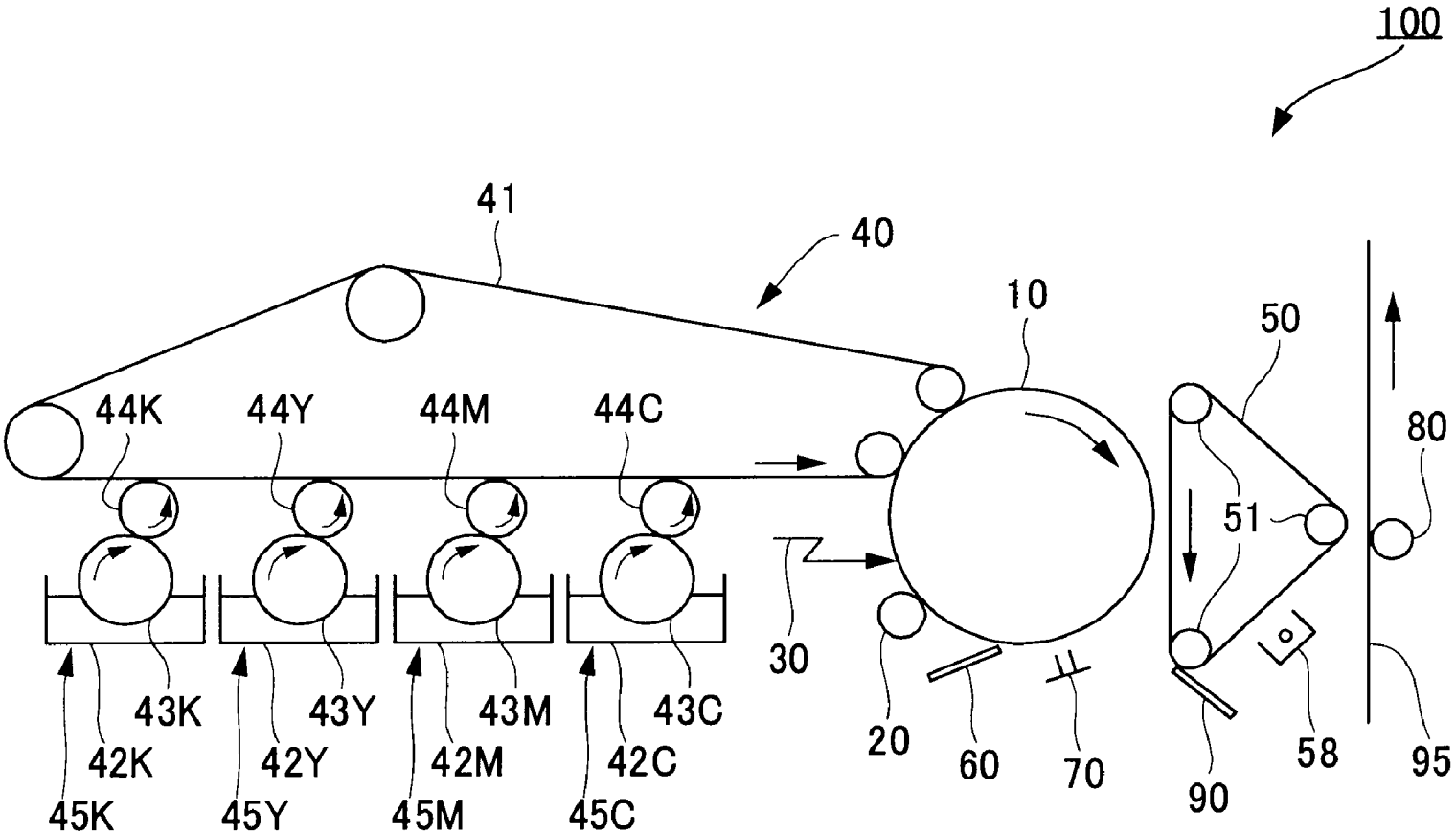
FIG. 2 is a schematic explanatory diagram showing one example of an image forming apparatus used in an image forming method of the present invention.

In the image forming apparatus 100 shown in FIG. 2, the photoconductor drum 10 is uniformly charged by means of the charging roller 20. The photoconductor drum 10 is exposed to a light imagewise by the exposure device 30 to form a latent electrostatic image. The latent electrostatic image formed on the photoconductor drum 10 is supplied with a toner from the developing device 40 to form a visible image (toner image). The visible image (toner image) is primarily transferred onto the intermediate transfer member 50 by a bias voltage applied from the rollers 51 (primary transferring), and is further transferred to the recording medium 95 (secondary transferring). In this way a transferred image is formed on the recording medium 95. Subsequently, a residual toner remaining on the photoconductor drum 10 is removed by means of the cleaning device 60, and charges remaining on the photoconductor drum 10 are eliminated by means of the charge eliminating lamp 70 on a temporary basis.

Figure 3:
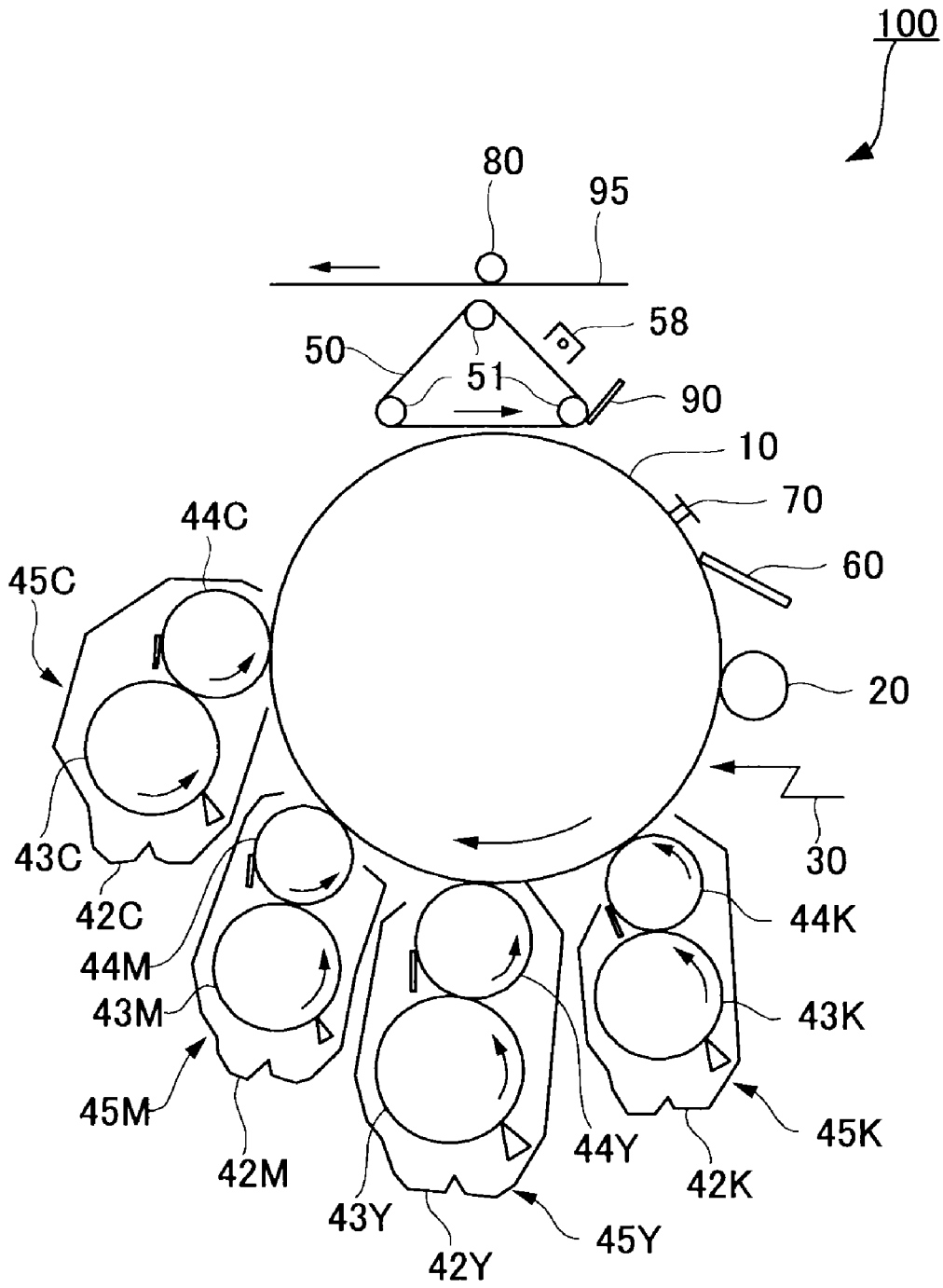
FIG. 3 is a schematic explanatory diagram showing another example of an image forming apparatus used in an image forming method of the present invention.

Next, another embodiment of the image forming method of the present invention by means of the image forming apparatus will be explained with reference to FIG. 3. An image forming apparatus 100 shown in FIG. 3 has an identical configuration and working effects to those of the image forming apparatus 100 shown in FIG. 2 except that this image forming apparatus 100 is not equipped with the developing belt 41 as a developer bearing member and that the black developing unit 45K, yellow developing unit 45Y, magenta developing unit 45M and cyan developing unit 45C are disposed around the periphery of the photoconductor drum 10. The reference numerals in FIG. 3 that are identical to those of FIG. 2 are denoted by the same reference numerals as those of FIG. 2.

Figure 4:
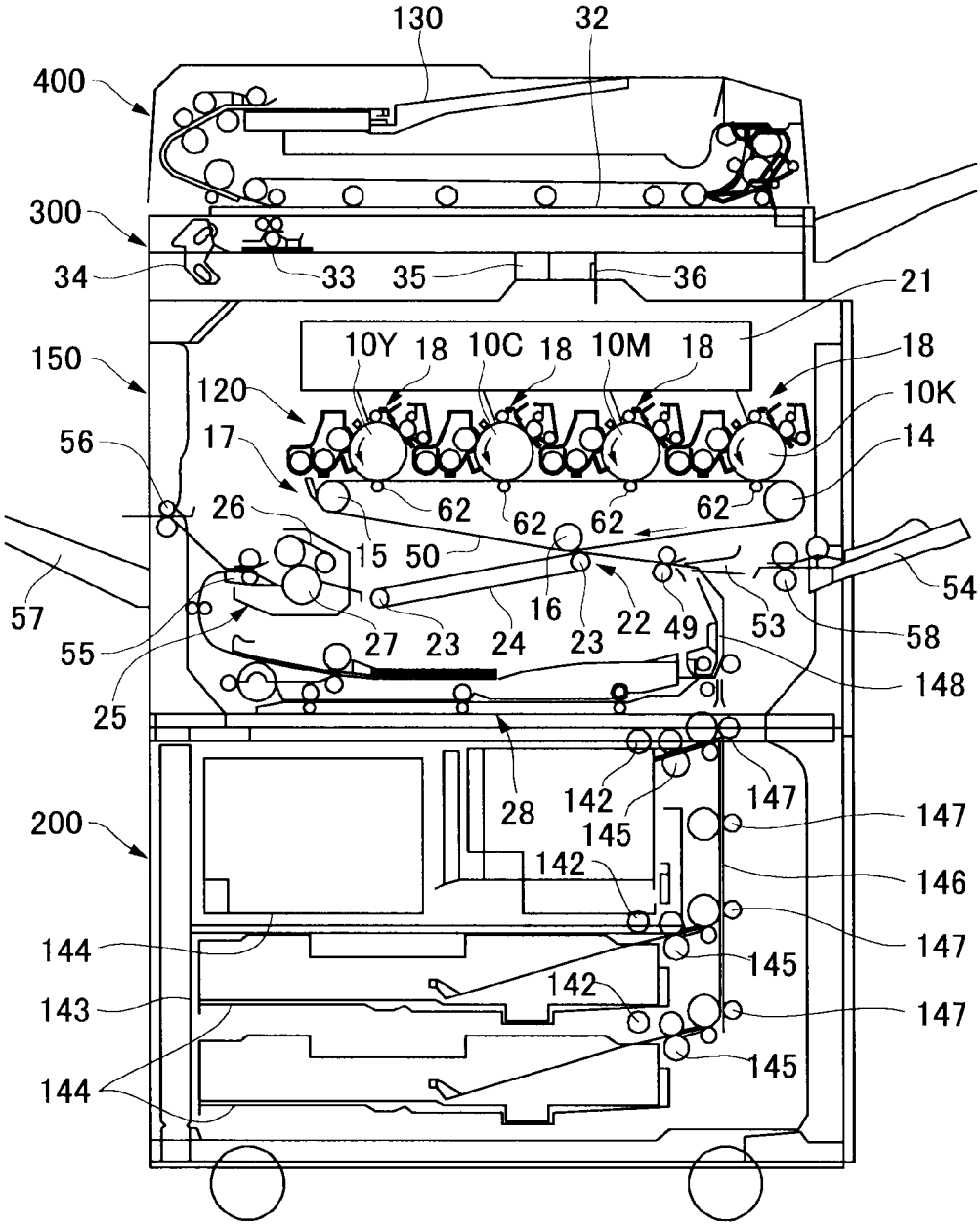
FIG. 4 is a schematic explanatory diagram showing one example of an image forming apparatus (tandem type color-image forming apparatus) used in an image forming method of the present invention.

Still another embodiment of the image forming method of the present invention by means of the image forming apparatus will be described with reference to FIG. 4. An image forming apparatus shown in FIG. 4 is a tandem color image-forming apparatus. The tandem image forming apparatus is equipped with a copier main body 150, a sheet-feeder table 200, a scanner 300, and an automatic document feeder (ADF) 400.

The copier main body 150 has an endless-belt intermediate transfer member 50 in its center. The intermediate transfer member 50 is spanned over support rollers 14, 15 and 16 so as to be rotatable in a clockwise direction in FIG. 4. An intermediate transfer member cleaning unit 17 for removing a residual toner remaining on the intermediate transfer member is provided in the vicinity of the support roller 15. On the surface of the intermediate transfer member 50 spanned over the support rollers 14 and 15, four color-image forming units 18 of yellow, cyan, magenta, and black are arranged along the conveyance direction of the intermediate transfer member 50 to constitute a tandem developing unit 120. An exposing device 21 is arranged adjacent to the tandem developing unit 120. A secondary transfer device 22 is arranged across the intermediate transfer member 50 from the tandem developing unit 120. The secondary transfer device 22 is provided with a secondary transferring belt 24, an endless belt, which is spanned over a pair of rollers 23. A recording medium conveyed on the secondary transferring belt 24 is allowed to contact with the intermediate transfer member 50. An image fixing device 25 is equipped with a fixing belt 26 in the form of an endless belt, and a pressurizing roller 27 which is positioned so as to be pressed against the fixing belt 26.

In the vicinity of the secondary transfer device 22 and the image fixing device 25, a sheet reverser 28 is placed. The sheet reverser 28 turns over a transferred sheet to form images on both sides of the transferred sheet (recording medium).

Next, full-color image formation (color copying) using the tandem developing unit 120 will be described. At first, a source document is placed on a document platen 130 of the automatic document feeder 400. Alternatively, the automatic document feeder 400 is opened, the source document is placed on a contact glass 32 of the scanner 300, and the automatic document feeder 400 is closed.

When a start switch (not shown) is pushed, the source document placed on the automatic document feeder 400 is moved to the contact glass 32, and a scanner 300 is then driven to operate first and second carriages 33 and 34. In the case where the source document is placed on the contact glass 32 from the beginning, the scanner 300 is immediately driven after pushing of the start switch. Light is applied from a light source to the document by means of the first carriage 33, and light reflected from the document is further reflected by the mirror of the second carriage 34. The reflected light passes through an image-forming lens 35, and a read sensor 36 receives it. In this way the color document (color image) is scanned, producing 4 types of color image information of black, yellow, magenta, and cyan.

Figure 5:
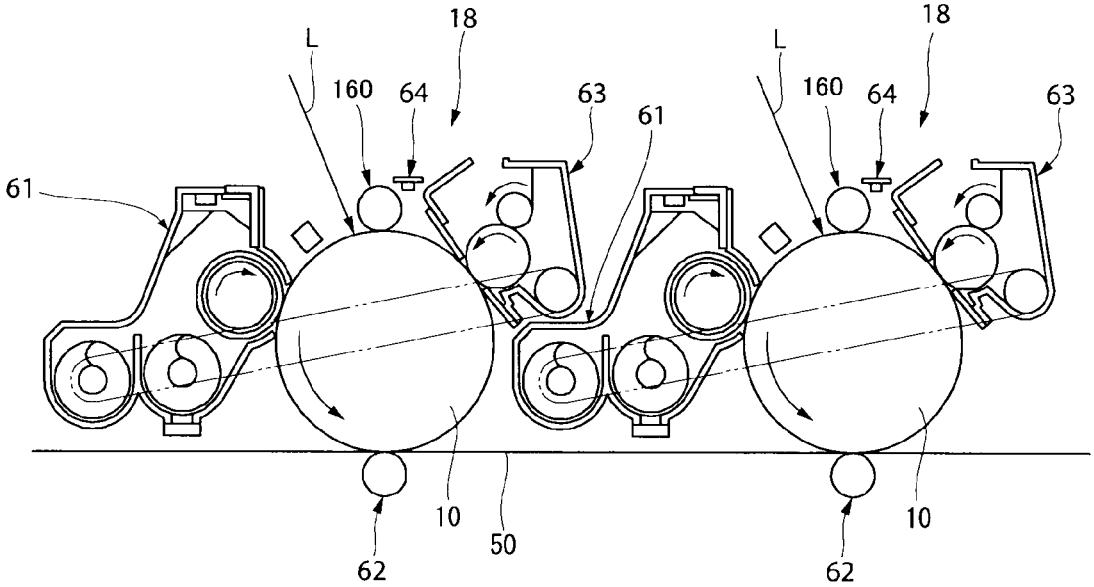
FIG. 5 is a partially-enlarged explanatory diagram of the image forming apparatus shown in FIG. 4.

Each piece of the color image information of black, yellow, magenta, and cyan is transmitted to the image forming units 18 (black image forming unit, yellow image forming unit, magenta image forming unit, or cyan image forming unit) of the tandem developing unit 120, and toner images of each color are formed in the image-forming units 18. As shown in FIG. 5, each of the image-forming units 18 (black image-forming unit, yellow image forming unit, magenta image forming unit, and cyan image forming unit) of the tandem developing unit 120 is equipped with a latent electrostatic image bearing member 10 (latent electrostatic image bearing member for black 10K, latent electrostatic image bearing member for yellow 10Y, latent electrostatic image bearing member for magenta 10M, or latent electrostatic image bearing member for cyan 10C); a charger 160 for uniformly charging the surface of each of the latent electrostatic image bearing members 10; an exposure device for exposing image-wise the surface of each of the latent electrostatic image bearing members 10 to light (denoted by "L" in FIG. 5) based on the corresponding each color image information to form a latent electrostatic image corresponding to the color image on each of the latent electrostatic image bearing members 10; a developing device 61 for developing the latent electrostatic image using the corresponding color toner (black toner, yellow toner, magenta toner, or cyan toner) to form each color toner image; a transfer charger 62 for transferring the each color toner image to an intermediate transfer member 50; a cleaning device 63; and a charge eliminating device 64. Thus, images of different colors (a black image, a yellow image, a magenta image, and a cyan image) can be formed based on the each color image information. The thus formed each color images, i.e. the black toner image formed on the latent electrostatic image bearing member for black 10K, yellow toner image formed on the latent electrostatic image bearing member for yellow 10Y, magenta toner image formed on the latent electrostatic image bearing member for magenta 10M, and cyan toner image formed on the latent electrostatic image bearing member for cyan 10C are sequentially transferred onto the intermediate transfer member 50 which rotates by the rotation of support rollers 14, 15 and 16 (primary transferring). These toner images of black, yellow, magenta and cyan are superimposed on the intermediate transfer member 50, thereby forming a composite color image (color transferred image).

In the meanwhile, one of feed rollers 142 of the paper feed table 200 is selectively rotated, whereby sheets of recording medium are ejected from one of multiple paper feed cassettes 144 in a paper bank 143 and are separated one by one by a separation roller 145. Subsequently, the sheet is fed to a feed path 146, conveyed by a conveying roller 147 into a feed path 148 inside the copier main body 150 and is bumped against a resist roller 49 to stop. Alternatively, one of the feed rollers 142 is rotated to eject the recording medium placed on a manual feed tray 54. The sheets are then separated one by one by means of the separation roller 145, and the sheet is fed into a manual feed path 53, and similarly, is bumped against the resist roller 49 to stop. The resist roller 49 is generally earthed, but it may be used under application of a bias for removing paper dust on the recording medium. The resist roller 49 is rotated synchronously with the movement of the composite color image on the intermediate transfer member 50 to send the sheet of recording medium into between the intermediate transfer member 50 and the secondary transfer device 22, and the composite color image is transferred onto the sheet by means of the secondary transfer device 22 (secondary transferring). Thereby a color image is formed on the sheet. After image transferring, a residual toner remaining on the intermediate transfer member 50 is removed by means of an intermediate transfer member cleaning device 17.

The sheet of recording medium with the transferred color image formed thereon is sent by the secondary transfer device 22 into an image fixing device 25, where the composite color image (color transferred image) is fixed on the sheet (recording medium) by heat and pressure. Subsequently, the sheet changes its direction by action of a switch blade 55, ejected by an ejecting roller 56, and stacked on an output tray 57. Alternatively, the sheet changes its direction by action of the switch blade 55, is flipped over by means of a sheet reverser 28, and transferred back to the image transfer section for recording of another image on the other side thereof. The sheet that bears images on both sides is then ejected by means of an ejecting roller 56, and is stacked on an output tray 57.

With use of the image forming method, the image forming apparatus and the process cartridge of the present invention, it is possible to effectively form high-quality images, because the toner which makes a significant contribution to biomass production and can meet a desired image quality.

EXAMPLES

Hereinafter, specific Examples of the present invention will be described which however shall not be construed as limiting the scope of the present invention.

In the following Examples and Comparative Examples, "a softening point of polyester resin", "a glass transition temperature (Tg) of polyester resin", "a softening point of rosin", "acid values of polyester resin and rosin", "a hydroxyl value of polyester resin", "the amount of low-molecular weight components having a weight average molecular weight of 500 or less", "an SP value of rosin", and "(meth)acrylic acid-modified degree of rosin" were respectively measured according to the following methods.

<Softening Point of Polyester Resin>

To 1 g of a sample, a load of 1.96 MPa was applied by means of a plunger of a flow tester (CFT-500D, manufactured by Shimadzu Corporation) while heating the sample at a temperature increase rate of 6° C./min so as to be ejected from a nozzle having a diameter of 1 mm and a length of 1 mm. The fall rate of the plunger of the flow tester was plotted with respect to temperature, and a temperature at which a one-half amount of the sample has flowed out from the nozzle was determined as a softening point.

<Glass Transition Temperature of Polyester Resin>

Using a differential scanning calorimeter (DSC210, manufactured by Seiko Instruments Inc.), 0.01 g to 0.02 g of a sample was weighed into an aluminum pan. Next, the temperature of the sample was increased to 200° C., and then cooled from 200° C. to 0° C. at a temperature decrease rate of 10° C./min, followed by increasing the temperature at a temperature increase rate of 10° C./min. Then, a temperature corresponding to a point of intersection of a direct extension of the baseline temperature for a region of a lower temperature side of DSC curve from a peak endothermic temperature (maximum endothermic temperature), and a tangent that shows the maximum inclination from a temperature-rise portion of the peak endothermic temperature to the peak top temperature was defined as the glass transition temperature of the sample.

<Softening Point of Rosin>

(1) Preparation of Sample

Ten grams of rosin was melted at a temperature of 170° C. on a hot plate for 2 hours, and then naturally cooled in open air at 25° C. with a relative humidity of 50% for 1 hour. Then, the resulting rosin was crushed by a coffee mill (NATIONAL MK-61M, manufactured by Panasonic Corporation) for 10 seconds, thereby preparing a rosin sample.

(2) Measurement

To 1 g of a sample, a load of 1.96 MPa was applied by means of a plunger of a flow tester (CFT-500D, manufactured by Shimadzu Corporation) while heating the sample at a temperature increase rate of 6° C./min so as to be ejected from a nozzle having a diameter of 1 mm and a length of 1 mm. The fall rate of the plunger of the flow tester was plotted with respect to temperature, and a temperature at which a one-half amount of the sample has flowed out from the nozzle was determined as a softening point.

<Acid Values of Polyester Resin and Rosin>

The acid values of polyester resin and rosin were measured according to the method described in JIS K0070. Note that only for the solvent used in the measurement, a mixture solvent composed of acetone and toluene (volume ratio of acetone:toluene=1:1) was used instead of a mixture solvent composed of ethanol and ether, which is specified in JIS K0070.

<Hydroxyl Value of Polyester Resin>

The hydroxyl value of polyester resin was measured according to the method described in JIS K0070.

<Amount of Low-Molecular Weight Components Having a Weight Average Molecular Weight of 500 or Less>

The amount of low-molecular weight components having a weight average molecular weight of 500 or less was measured by GPC (gel permeation chromatography). Into 30 mg of toner, 10 mL of tetrahydrofuran was added, and mixed in a ball mill for 1 hour, and the mixture was filtrated through a fluorine resin filter having a pore size of 2 μm, FP-200 (manufactured by Sumitomo Electric Industries, Ltd.) so as to remove insoluble components from the mixture, thereby preparing a sample solution.

In a thermostatic chamber, tetrahydrofuran was flowed as an eluting solution at a flow rate of 1 mL/min, the temperature of a column was maintained at 40° C. in the thermostatic chamber, and 100 μL of the sample solution was injected into the column to thereby measure the amount of low-molecular weight components. Note that as the analyzing column used in the analysis, GMHLX+G3000HXL (manufactured by Tosoh Corporation) was used. As calibration curves of distribution of molecular weights, calibration curves of several types monodisperse polystyrene ($2.63\times10^3$, $2.06\times10^4$, and $1.02\times10^5$, produced by Tosoh Corporation) and ($2.10\times10^3$, $7.00\times10^3$, $5.04\times10^4$, produced by GL. Science Inc.) were prepared as those of standard samples.

Specifically, the amount of low-molecular weight components having a weight average molecular weight of 500 or less was determined as the proportion (%) of the plot area of a chart obtained by a refractive index (RI) detector <Measurement of SP Value of Rosin>

Each sample of rosin (2.1 g) in a molten state was poured into a predetermined ring, and cooled to the room temperature, and then an SP value of each of the samples was measured according to the method described in JIS B7410 under the following conditions.

measurement device: automatic ring and ball softening point tester (ASP-MGK2, manufactured by MEITECH Company Ltd.)

temperature increase rate: 5° C./min starting temperature of temperature increase: 40° C.

solvent used in measurement: glycerin

<Measurement of (Meth)Acrylic Acid-Modified Degree of Rosin>

The (meth)acrylic acid-modified degree was calculated by the following Equation (1):

$$\text{(Meth)acrylic acid-modified degree} = \frac{X_1 - Y}{X_2 - Y} \times 100 \qquad \text{Equation (1)}$$

In Equation (1), $X_1$ represents an SP value of a (meth) acrylic acid-modified rosin used to calculate the modification value; $X_2$ represents a saturated SP value of a (meth)acrylic acid-modified rosin obtained by reacting 1 moL of acrylic acid with 1 moL of rosin; and Y represents an SP value of the rosin.

The term "SP value" means a softening point measured by the after-mentioned ring and ball automatic softening point measuring apparatus. The term "saturated SP value" means an SP value obtained when the reaction between a (meth) acrylic acid and a rosin is performed until the SP value of the resulting (meth)acrylic acid-modified rosin reaches a saturated value. Note that as for the molecular weight of 1 moL of rosin, when the acid value of the rosin is represented by x (mgKOH/g), x mg ($x\times10^{-3}$ g) of potassium hydroxide (molecular weight: 56.1) is reacted per gram of the rosin, and thus, the molecular weight can be calculated by the equation, molecular weight=(56,100÷x).

<Purification of Rosin>

A 2,000 mL distillation flask equipped with a fractionating column, a reflux condenser and a receiver was charged with 1,000 g of tall rosin, and the tall rosin was distilled under reduced pressure of 1 kPa, and then a distillate obtained at 195° C. to 250° C. was sampled as a main fraction. Hereinafter, a tall rosin used in the purification is called "unpurified rosin", and a rosin sampled as a main fraction is called "purified rosin".

Each rosin (20 g) was crushed by a coffee mill (NATIONAL MK-61M, manufactured by Panasonic Corporation) for 5 seconds and passed through a sieve of 1 mm mesh, and 0.5 g of the sieved rosin powder was weighed in a head space vial (20 mL). A head space gas was sampled, and impurities in the unpurified rosin and in the purified rosin were analyzed by Head Space GC-MS under the following conditions. The results are shown in Table 1.

<Measurement Conditions for Head Space GC-MS>

A. Head Space sampler (HP7694, manufactured by Agilent)

Sample temperature: 200° C.

Loop temperature: 200° C.

Transfer line temperature: 200° C.
Equilibrating time for sample heating: 30 min
Vial pressure gas: helium (He)
Vial pressing time: 0.3 min
Loop filling time: 0.03 min
Loop equilibrating time: 0.3 min
Charging time: 1 min B. GC (gas chromatography) (HP6890, manufactured by Agilent)
Analyzing column: DB-1 (60 m-320 μm-5 μm)
Carrier: helium (He)
Flow rate conditions: 1 mL/min
Charging inlet temperature: 210° C.
Column head pressure: 34.2 kPa
Charging mode: split
Split ratio: 10:1
Oven temperature conditions: 45° C. (3 min)-10° C./min-280° C. (15 min)

C. MS (Mass Spectroscopy) (HP5973, manufactured by Agilent)
Ionization method: EI (Electron Impact) method
Interface temperature: 280° C.
Ion source temperature: 230° C.
Quadrupole temperature: 150° C.
Detection mode: Scan 29 m/s to 350 m/s

TABLE 1

| | Hexanoic acid | Pentanoic acid | Benzaldehyde | n-hexanol | 2-pentyl-furan | SP value (° C.) Softening point (° C.) | Acid value (mgKOH/g) | Molecular weight/moL |
|---|---|---|---|---|---|---|---|---|
| Unpurified rosin | $0.9 \times 10^7$ | $0.6 \times 10^7$ | $0.6 \times 10^7$ | $1.8 \times 10^7$ | $1.1 \times 10^7$ | 77.0<br>74.3 | 169 | 332 |
| Purified rosin | $0.4 \times 10^7$ | $0.2 \times 10^7$ | $0.2 \times 10^7$ | $1.4 \times 10^7$ | $0.7 \times 10^7$ | 76.8<br>75.1 | 166 | 338 |

<Measurement of Saturated SP Value of Acrylic Acid-Modified Rosin Using Unpurified Rosin>

A 1,000 mL flask equipped with a fractionating column, a reflux condenser and a receiver was charged with 332 g (1 moL) of an unpurified rosin (SP value=77.0° C.) and 72 g of acrylic acid (1 moL), and the temperature of the mixture was raised from 160° C. to 230° C. over a period of 8 hours. After having confirmed that the SP value did not increase at 230° C., the unreacted acrylic acid and low-boiling point substances were distilled away from the reaction mixture at 230° C. under reduced pressure of 5.3 kPa to thereby obtain an acrylic acid-modified rosin. The resulting acrylic acid-modified rosin had an SP value, i.e., a saturated SP value of the acrylic acid-modified rosin using the unpurified rosin, of 110.1° C.

<Measurement of Saturated SP Value of Acrylic Acid-Modified Rosin Using Purified Rosin>

A 1,000 mL flask equipped with a fractionating column, a reflux condenser and a receiver was charged with 338 g (1 moL) of a purified rosin (SP value=76.8° C.) and 72 g of acrylic acid (1 moL), and the temperature of the mixture was raised from 160° C. to 230° C. over a period of 8 hours. After having confirmed that the SP value did not increase at 230° C., the unreacted acrylic acid and low-boiling point substances were distilled away from the reaction mixture at 230° C. under reduced pressure of 5.3 kPa to thereby obtain an acrylic acid-modified rosin. The resulting acrylic acid-modified rosin had an SP value, i.e., a saturated SP value of the acrylic acid-modified rosin using the purified rosin, of 110.4° C.

Synthesis Example 1

—Synthesis of Acrylic Acid-Modified Rosin A—

A 10 L flask equipped with a fractionating column, a reflux condenser and a receiver was charged with 6,084 g (18 moL) of a purified rosin (SP value=76.8° C.) and 907.9 g (12.6 moL) of acrylic acid, and the temperature of the mixture was raised from 160° C. to 220° C. over a period of 8 hours. Then, the mixture was reacted at 220° C. for 2 hours and further distilled under reduced pressure of 5.3 kPa to thereby synthesize acrylic acid-modified rosin A. The resulting acrylic acid-modified rosin A had an SP value of 110.4° C. and an acrylic acid-modified degree of 100.

Synthesis Example 2

—Synthesis of Acrylic Acid-Modified Rosin B—

A 10 L flask equipped with a fractionating column, a reflux condenser and a receiver was charged with 6,084 g (18 moL) of a purified rosin (SP value=76.8° C.) and 648.5 g (9.0 moL) of acrylic acid, and the temperature of the mixture was raised from 160° C. to 220° C. over a period of 8 hours. Then, the mixture was reacted at 220° C. for 2 hours and further distilled under reduced pressure of 5.3 kPa to thereby synthesize acrylic acid-modified rosin B. The resulting acrylic acid-modified rosin B had an SP value of 99.1° C. and an acrylic acid-modified degree of 66.4.

Synthesis Example 3

—Synthesis of Acrylic Acid-Modified Rosin C—

A 10 L flask equipped with a fractionating column, a reflux condenser and a receiver was charged with 6,084 g (18 moL) of a purified rosin (SP value=76.8° C.) and 259.4 g (3.6 moL) of acrylic acid, and the temperature of the mixture was raised from 160° C. to 220° C. over a period of 8 hours. Then, the mixture was reacted at 220° C. for 2 hours and further distilled under reduced pressure of 5.3 kPa to thereby synthesize acrylic acid-modified rosin C. The resulting acrylic acid-modified rosin C had an SP value of 91.9° C. and an acrylic acid-modified degree of 44.9.

Synthesis Examples 4 to 8 and 11 to 12

A 5-litter four-necked flask equipped with a nitrogen inlet tube, a dehydrating tube, a stirrer and a thermocouple was charged with the alcohol component(s), the carboxylic acid components other than trimellitic acid anhydride and the esterified catalyst shown in Tables 2-1 and 2-2, and the mixture was subjected to a polycondensation reaction at 230° C. under a nitrogen atmosphere for 10 hours, and further reacted at 230° C. under a pressure of 8 kPa for 1 hour. After the reaction mixture was cooled to 220° C., the trimellitic acid anhydride shown in Tables 2-1 and 2-2 was added to the reaction mixture, the resulting mixture was reacted under normal pressure (101.3 kPa) for 1 hour, and further reacted at 220° C. under a pressure of 20 kPa until the temperature reached a desired softening point to thereby synthesize polyester resins of Synthesis Examples 4 to 8 and 11 to 12.

Synthesis Example 9

A 5-litter four-necked flask equipped with a nitrogen inlet tube, a dehydrating tube, a stirrer and a thermocouple was charged with the alcohol component, the carboxylic acid components other than fumaric acid and the esterified catalyst shown in Table 2-2, and the mixture was subjected to a polycondensation reaction at 230° C. under a nitrogen atmosphere for 10 hours, and further reacted at 230° C. under a pressure of 8 kPa for 1 hour. After the reaction mixture was cooled to 180° C., the fumaric acid shown in Table 2-2 was added to the reaction mixture, the temperature of the resulting mixture was raised to 210° C. over a period of 5 hours, and the reaction mixture was further reacted at 210° C. under a pressure of 10 kPa until the temperature reached a desired softening point to thereby synthesize a polyester resin of Synthesis Example 9.

Synthesis Example 10

A 5-litter four-necked flask equipped with a nitrogen inlet tube, a dehydrating tube, a stirrer and a thermocouple was charged with 2,205 g of polyoxypropylene(2.2)-2,2-bis(4-hydroxyphenyl)propane and 877.5 g of polyoxyethylene (2.2)-2,2-bis(4-hydroxyphenyl)propane as alcohol components, 896.4 g of terephthalic acid and 442.2 g of the acrylic acid-modified rosin A as carboxylic acid components other than trimellitic acid anhydride, and 20 g of dibutyltin oxide as an esterified catalyst, and the mixture was reacted for 1 hour at 230° C. under a nitrogen atmosphere and a pressure of 8.0 kPa. After the reaction mixture was cooled to 220° C., 249.6 g of trimellitic acid anhydride was added to the reaction mixture, the resulting mixture was reacted under normal pressure for 1 hour, and further reacted at 220° C. under a pressure of 20 kPa until the temperature reached its softening point, i.e. 125.6° C., thereby synthesizing a polyester resin of Synthesis Example 10, which had a glass transition temperature of 60.6° C. and an acid value of 8 mgKOH/g.

TABLE 2-1

| | | Syn. Ex. 4 | Syn. Ex. 5 | Syn. Ex. 6 | Syn. Ex. 7 | Syn. Ex. 8 |
|---|---|---|---|---|---|---|
| Alcohol component | BPA-PO[1)] | 2,100 g | 2,100 g | 2,100 g | 2,975 g | 2,450 g |
| | BPA-EO[2)] | 487.5 g | 487.5 g | 487.5 g | | |
| Carboxylic acid component | Terephthalic acid | 871.5 g | 871.5 g | 871.5 g | 767 g | 415 g |
| | Trimellitic acid anhydride | 144 g | 144 g | 144 g | 384 g | 19.2 g |
| | Fumaric acid | — | — | — | — | — |
| | Unpurified rosin* | — | — | — | — | — |
| | Acrylic acid-modified rosin A | 603 g | — | — | 380 g | 1,809 g |
| | Acrylic acid-modified rosin B | — | 603 g | — | — | — |
| | Acrylic acid-modified rosin C | — | — | 603 g | — | — |
| Esterified catalyst | Dibutyltin oxide | — | — | — | — | — |
| | Tin (II) octanoate | 20 g | 20 g | 20 g | 21 g | — |
| | Dodecenyl succinic anhydride | — | — | — | — | — |
| | Titanium diisopropylate-bis(triethanol-aminate) | — | — | — | — | 30 g |
| Amount of rosin contained in carboxylic acid component (% by mass) | | 37.3 | 37.3 | 37.3 | 24.0 | 80.6 |
| Physical properties of polyester resin | Acid value (mgKOH/g) | 35 | 32 | 26 | 18 | 25 |
| | Hydroxyl value (mgKOH/g) | 15 | 10 | 8 | 18 | 18 |
| | Softening point (° C.) | 120.5 | 115.8 | 114.6 | 140.8 | 100.5 |
| | Glass transition temperature (° C.) | 65.6 | 62.3 | 58.5 | 68.0 | 53.2 |
| | Amount of low-molecular weight components having molecular weight of 500 or less | 4.1 | 6.0 | 7.6 | 5.4 | 8.5 |

TABLE 2-2

| | | Syn. Ex. 9 | Syn. Ex. 10 | Syn. Ex. 11 | Syn. Ex. 12 |
|---|---|---|---|---|---|
| Alcohol component | BPA-PO[1)] | 2,625 g | 2,205 g | 1,990 g | 2,100 g |
| | BPA-EO[2)] | — | 877.5 g | 800 g | 487.5 g |
| Carboxylic acid component | Terephthalic acid | 614.2 g | 896.4 g | 600 g | 871.5 g |
| | Trimellitic acid anhydride | — | 249.6 g | — | 144 g |
| | Fumaric acid | 348 g | — | — | — |
| | Unpurified rosin* | — | — | — | 660 g |
| | Acrylic acid-modified rosin A | 402 g | 442.2 g | — | — |
| | Acrylic acid-modified rosin B | — | — | — | — |
| | Acrylic acid-modified rosin C | — | — | — | — |
| Esterified catalyst | Dibutyltin oxide | 20 g | 20 g | — | — |
| | Tin (II) octanoate | — | — | — | 20 g |
| | Dodecenyl succinic anhydride | — | — | 500 g | — |
| | Titanium diisopropylate-bis(triethanol-aminate) | — | — | — | — |

TABLE 2-2-continued

| | | Syn. Ex. 9 | Syn. Ex. 10 | Syn. Ex. 11 | Syn. Ex. 12 |
|---|---|---|---|---|---|
| Amount of rosin contained in carboxylic acid component (% by mass) | | 29.5 | 27.8 | 0 | 39.4 |
| Physical properties of polyester resin | Acid value (mgKOH/g) | 18 | 8 | 18 | 26 |
| | Hydroxyl value (mgKOH/g) | 15 | 30 | 20 | 35 |
| | Softening point (° C.) | 108 | 125.6 | 150 | 110.4 |
| | Glass transition temperature (° C.) | 58.2 | 60.6 | 61.8 | 53.6 |
| | Amount of low-molecular weight components having molecular weight of 500 or less | 6.6 | 7.5 | 9.3 | 14.8 |

*Unpurified rosin: unmodified rosin
BPA-PO[1]: polyoxypropylene(2.2)-2,2-bis(4-hydroxyphenyl)propane
BPA-PO[2]: polyoxyethylene(2.2)-2,2-bis(4-hydroxyphenyl)propane

Example 1

<Production of Toner T -1>

—Toner Composition—

| | |
|---|---|
| polyester resin of Synthesis Example 4 | 100 parts by mass |
| carnauba wax (produced by CERARICA NODA Co., Ltd.) | 3 parts by mass |
| carbon black (#C44, produced by Mitsubishi Chemical Co., Ltd.) | 5 parts by mass |
| charge controlling agent (E-84, produced by Orient Chemical Industries Ltd.) | 1 part by mass |

A toner composition having the above formulation was premixed by a HENSCHEL mixer (FM10B, manufactured by Mitsui Miike Kakouki Co., Ltd.) and subsequently kneaded with a biaxial kneader (PCM-30, manufactured by IKEGAI, LTD.). Next, the kneaded product was finely pulverized using a supersonic jet pulverizer (LABOJET: manufactured by Nihon Pneumatic Industry Co., Ltd.) and subsequently subjected to classification with an air classifier (MDS-I, manufactured by Nihon Pneumatic Industry Co., Ltd.) to thereby yield a toner base particle. The resulting toner base particle had a volume average particle diameter of 7.1 μm, which was measured as explained below.

Next, 1.0 part by mass of a colloidal silica (H-2000, produced by Clariant) was mixed with respect to 100 parts by mass of the toner base particle using a sample mill, thereby producing Toner T-1.

Examples 2 to 6, Comparative Examples 1 and 2, and Reference Example 1

—Production of Toner T-2 to Toner T-9—

Each of Toner T-2 to Toner T-9 was produced in a similar manner to that described in Example 1, except that each toner composition having the formulation as described in Table 3 was used instead of the formulation of toner described in Example 1.

<Volume Average Particle Diameter of Toner>

The volume average particle diameter of each toner was measured using a particle size measurement device (MULTISIZER III, manufactured by Beckman Coulter Co.) with an aperture diameter of 100 μm to obtain measurement data, and the data was analyzed with analysis software, BECKMAN COULTER MULTISIZER 3 VER. 3.51. More specifically, into a 100 mL glass beaker, 0.5 mL of a 10% by mass surfactant (alkylbenzene sulfonate, NEOGEN SC-A, produced by DAIICHIKOGYO CO., LTD.) and 0.5 g of resulting each toner were added and stirred with a micro spatula, and subsequently 80 mL of ion exchange water was added, thereby obtaining a dispersion liquid. The resulting dispersion liquid was subjected to a dispersion treatment for 10 minutes by means of a ultrasonic dispersing machine (W-113MK-II, manufactured by Honda Electronics Co., Ltd.). The volume average particle diameter of the dispersion liquid was measured by the particle size measurement device, MULTISIZER III, with a solution for measurement, ISOTON III (produced by Beckman Coulter Co.). In the measurement, the toner sample dispersion liquid was delivered by drops so that the concentration indicated by the device was 8% by mass ±2% by mass. In this measurement method, it is important to adjust the concentration within the range of 8% by mass ±2% by mass, in terms of measurement reproductivity of particle diameter. Within the concentration range, no measurement error will occur.

Thirteen channels each having the following pore size were used to measure toner particles having particles diameters of equal to or greater than 2.00 μm and smaller than 40.30 μm:

2.00 μm≦ and <2.52 μm; 2.52 μm≦ and <3.17 μm; 3.17 μm≦ and <4.00 μm; 4.00 μm≦ and <5.04 μm; 5.04 μm≦ and <6.35 μm; 6.35 μm≦ and <8.00 μm; 8.00 μm≦ and <10.08 μm; 10.08 μm≦ and <12.70 μm; 12.70 μm≦ and <16.00 μm; 16.00 μm≦ and <20.20 μm; 20.20 μm≦ and <25.40 μm; 25.40 μm≦ and <32.00 μm; 32.00 μm≦ and <40.30 μm.

TABLE 3

| | Formulation of Toner | | | | | | Volume average particle |
|---|---|---|---|---|---|---|---|
| | No. | Resin 1 | Resin 2 | Wax | Pigment | Charge controlling agent | diameter of toner (μm) |
| Ex. 1 | T-1 | Synthesis Ex. 4 100 parts | — | Carnauba 3 parts | Carbon 5 parts | E-84 1 part | 7.1 |
| Ex. 2 | T-2 | Synthesis Ex. 5 100 parts | — | Carnauba 4 parts | Carbon 7 parts | E-84 2 parts | 7.8 |
| Ex. 3 | T-3 | Synthesis Ex. 6 | — | Carnauba 5 parts | Carbon 4 parts | E-84 1 part | 7.6 |

TABLE 3-continued

| | Formulation of Toner | | | | | | Volume average particle diameter of toner (μm) |
|---|---|---|---|---|---|---|---|
| | No. | Resin 1 | Resin 2 | Wax | Pigment | Charge controlling agent | |
| Ex. 4 | T-4 | 100 parts Synthesis Ex. 7 | — | Polypro 5 parts | red 122 6 parts | E-84 2 parts | 5.6 |
| Ex. 5 | T-5 | 100 parts Synthesis Ex. 8 | — | Carnauba 3 parts | red 122 7 parts | E-84 3 parts | 5.1 |
| Ex. 6 | T-6 | 100 parts Synthesis Ex. 9 | Synthesis Ex. 10 | Carnauba 3 parts | Carbon 5 parts | E-84 1 part | 7.2 |
| Comp. Ex. 1 | T-7 | 50 parts Synthesis Ex. 11 | 50 parts — | Carnauba 4 parts | Carbon 5 parts | E-84 1 part | 6.9 |
| Comp. Ex. 2 | T-8 | 100 parts Synthesis Ex. 11 | Synthesis Ex. 4 | Carnauba 3 parts | Carbon 5 parts | E-84 1 part | 7.4 |
| Ref. Ex. 1 | T-9 | 57.1 parts Synthesis Ex. 12 | 42.9 parts — | Carnauba 3 parts | Carbon 4 parts | E-84 2 parts | 7.2 |
| | | 100 parts | | | | | |

the term "part (or parts)" means "part (or parts) by mass"
Carnauba: carnauba wax produced by CERARICA NODA Co., Ltd.
Polypro: NP105, produced by Mitsui Chemicals, Inc.
Carbon: #C44, produced by Mitsubishi Chemical Co., Ltd.
red 122: C.I. Pigment red 122
E-84: produced by Orient Chemical Industries, Ltd Next, the concentration of radioactive carbon isotope $^{14}C$ of each of the produced toners was measured in the following manner, and the storage stability, and odor property thereof were evaluated. The evaluation results are shown in Table 4.

<Measurement of Radioactive Carbon Isotope $^{14}C$>

The concentration of radioactive carbon isotope $^{14}C$ of each of the toners was measured by radioactive carbon dating. Firstly, the toner was burned to reduce $CO_2$ (carbon dioxide) therein, yielding C (graphite). Then, the concentration of $^{14}C$ of the graphite was measured by AMS (Accelerator Mass Spectroscopy), produced by Beta analytic Co.

[Evaluation Criteria]

A: the concentration of radioactive carbon isotope $^{14}C$ is 10.8 pMC or higher.

D: the concentration of radioactive carbon isotope $^{14}C$ is less than 10.8 pMC.

<Storage Stability>

Two toner samples were prepared, in each of which 4 g of the toner was placed into an open-air cylinder vessel of 5 cm in diameter and 2 cm in height. One sample was left standing at a temperature of 40° C. with a relative humidity of 60% for 72 hours, and the other sample was left standing at a temperature of 55° C. with a relative humidity of 60% for 72 hours. After the standing, each of the vessels with the toner contained therein was lightly shaken, and whether or not aggregation of toner occurred was visually observed, thereby the storage stability of toner was evaluated based on the following criteria.

[Evaluation Criteria]

A: No aggregation of toner particles is observed under both conditions of 40° C. and 55° C.

B: No aggregation of toner particles is observed at 40° C., but a slight amount of aggregated toner particles was observed at 55° C.

C: A slight amount of aggregated toner particles is observed at 40° C., and aggregation of toner particles was clearly observed at 55° C.

D: Aggregation of toner particles is clearly observed under both conditions of 40° C. and 55° C.

<Odor Property>

Twenty grams of each toner was weighed in an aluminum cup, and the aluminum cup was left at rest for 30 minutes on a hot plate which had been heated at 150° C., and odor emitted from the toner was evaluated based on the following evaluation criteria. The evaluation results are shown in Table 3.

[Evaluation Criteria]

A: No odor is detected.

B: Almost no odor is detected.

C: Odor is slightly detected, but it had no problem in practical use.

D: Odor is strongly detected.

<Production of Two-Component Developer>

—Production of Carrier—

A magnetite core material (75 emu/g to 120 emu/g) having a volume average particle diameter of 60 μm and a magnetization intensity of 55 emu/g was coated with a silicone resin (KR206, produced by Shin-Etsu Chemical Co., Ltd.) by means of a fluidized bed coater, and the resultant resin was burned in an electric furnace at 300° C. for 3 hours, thereby producing a carrier.

Subsequently, 5 parts by mass of each toner was mixed with respect to 95 parts by mass of the resulting carrier, with a stirrer, thereby producing Developers 1 to 9.

Figure 6:
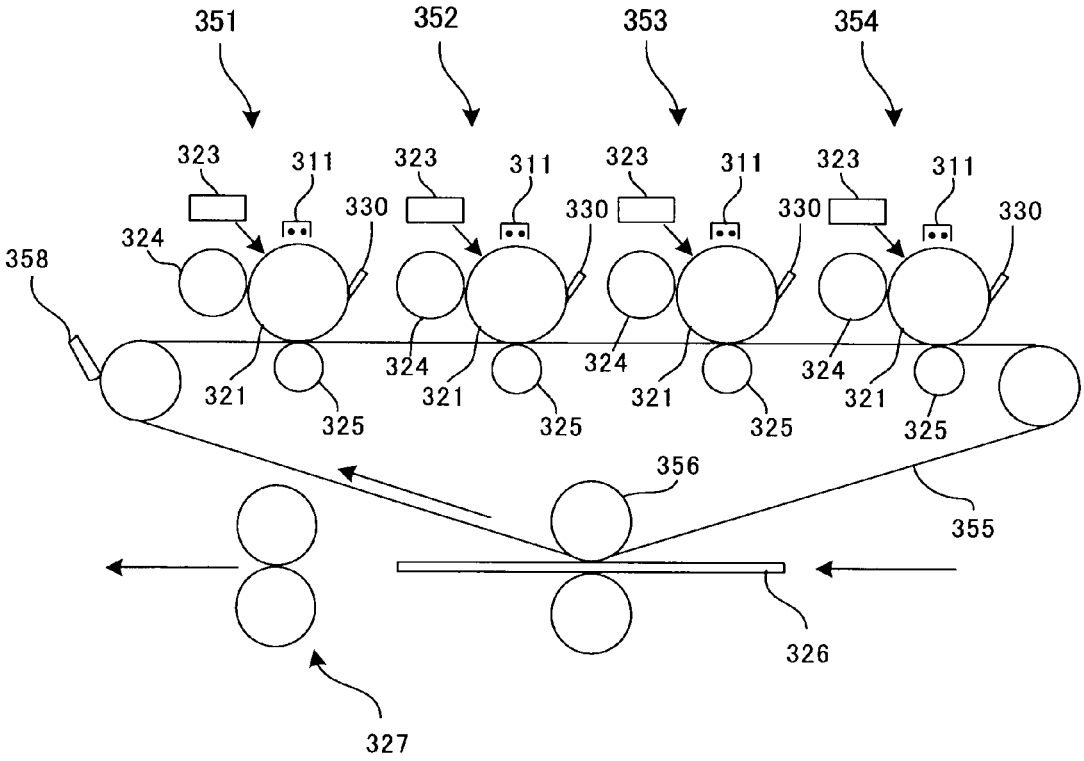
FIG. 6 is a schematic diagram showing an image forming apparatus used in Examples described below.

An image forming apparatus as shown in FIG. 6 was charged with each of the produced Developers 1 to 9, and formation of an image was carried out. Various properties of the Developers were evaluated as follows. The evaluation results are shown in Table 4.

<Image Forming Apparatus>

An image forming apparatus shown in FIG. 6 is a tandem image forming apparatus of an indirect transfer type, employing a non-contact charging method, a two-component developing method, a secondary transfer method, a blade cleaning, and an external heating roller fixing method.

The image forming apparatus shown in FIG. 6 employs a noncontact corona charger as a charging unit 311; a two-component developing device as a developing unit 324; a cleaning blade as a cleaning unit 330; and a roller fixing device of an electromagnetic induction heating type, as a fixing unit 327.

An image forming element 351 in the image forming apparatus shown in FIG. 6 is provided with a charging unit 311, an exposing unit 323, a developing unit 324, a primary transfer unit 325 and a cleaning unit 330 being arranged around a photoconductor drum 321. While the photoconductor drum 321 in the image forming element 351 is rotating, it is charged by the charging unit 311 and exposed to light by the exposing unit 323 to form a latent electrostatic image corresponding to an exposed image on a surface of the photoconductor drum 321. The electrostatic image is developed by the developing unit 324 using a yellow toner to form a visible image of yellow toner on the photoconductor drum 321. The visible image is then transferred to an intermediate transfer belt 355 by the primary transfer unit 325, and the yellow toner remaining on the photoconductor drum 321 is removed by the cleaning unit 330. In a similar manner, visible images of magenta toner, cyan toner and black toner are formed on the intermediate transfer belt 355 by each image forming elements 352, 353 and 354. Then, the visible toner images are superimposed, whereby a color image is formed on the intermediate transfer belt 355. The color image formed on the intermediate transfer belt 355 is then transferred onto a recording medium 326 by a transfer device 356, and the toner remaining on the intermediate transfer belt 355 is removed by an intermediate-transfer belt cleaning unit 358. The color image formed on the recording medium 326 is fixed by the fixing unit 327.

<Lower-Limit Fixing Temperature>

The above-mentioned image forming apparatus was adjusted so that a solid image formed of toner in an amount of 1.0 mg/cm$^2$±0.05 mg/cm$^2$ was developed on regular paper (Type 6200, produced by Ricoh Company Ltd.) and a heavy transfer paper (copy printing paper <135>, produced by NBS Ricoh Co., Ltd.) and the temperature of the fixing unit was variable. Subsequently, a temperature where no offset occurs was measured on the regular paper, and a lower-limit fixing temperature was measured on the heavy transfer paper. Note that the lower-limit fixing temperature was determined as a fixing belt temperature at which the residual ratio of image density of the resulting fixed image after having been rubbed with a pad became 70% or more.

[Evaluation Criteria]

A: The lower-limit fixing temperature is lower than 135° C.

B: The lower-limit fixing temperature is equal to or higher than 135° C. and lower than 145° C.

C: The lower-limit fixing temperature is equal to or higher than 145° C. and lower than 155° C.

D: The lower-limit fixing temperature is higher than 155° C.

<Image Quality>

The image quality was evaluated based on the presence or absence of a change in color tone (color tint), background smear, nonuniformity of image density and image thin spots. The presence or absence of abnormal image(s) and the quality of images were visually observed and evaluated with the following five grades.

[Evaluation Criteria]

A: There is no abnormal image observed, resulting in a favorable image quality.

B: Slight differences in color tint, image density, background smear and the like are observed, however, there would be no problem under normal temperature and humidity environments.

C: Differences in color tint, image density, background smear and the like are clearly observed, which is problematic.

<Temporal Stability>

After running output of 50,000 sheets of an image chart having a 35% image area using the image forming apparatus, a solid image was output on paper (Type 6000, produced by Ricoh Company Ltd.). The image quality of several sheets of paper printed after the start of the running test was compared to the image quality of sheets of paper printed after the completion of the running test, and the change in image quality was evaluated with three grades.

[Evaluation Criteria]

A: There is almost no difference in image quality between paper sheets printed at the start of the running test and paper sheets printed at the completion of the running test.

B: A difference in image quality is confirmed between paper sheets printed at the start of the running test and paper sheets printed at the completion of the running test, however, the difference is within an acceptable range.

C: There is a great difference in image quality between paper sheets printed at the start of the running test and paper sheets printed at the completion of the running test, and the difference is not within an acceptable range.

<Overall Evaluation>

A: Superior

B: The results deviate from the scope of the present invention or be tolerated in practical.

TABLE 4

| | No. | Concentration of $^{14}$C (pMC) | | Lower-limit fixing temperature | Temporal stability | Odor property | Storage stability | Image quality | Overall evaluation |
|---|---|---|---|---|---|---|---|---|---|
| Ex. 1 | T-1 | 21 | A | A | A | A | A | A | A |
| Ex. 2 | T-2 | 22 | A | A | A | A | A | A | A |
| Ex. 3 | T-3 | 23 | A | A | A | A | A | A | A |
| Ex. 4 | T-4 | 11 | A | B | A | A | A | A | A |
| Ex. 5 | T-5 | 64 | A | A | A | A | A | A | A |
| Ex. 6 | T-6 | 26 | A | A | A | A | A | A | A |
| Comp. Ex. 1 | T-7 | 0 | D | B | A | B | B | B | B |
| Comp. Ex. 2 | T-8 | 9 | D | B | B | B | B | B | B |
| Ref. Ex. 1 | T-9 | 22 | A | B | B | D | B | C | B |

Reference Example 1 had a $^{14}C$ concentration of 22 pMC, however, the $^{14}C$ concentration is substantially controlled by the polyester resin of Synthesis Example 12 using an unpurified rosin, and therefore, the odor property of toner degraded.

Since the toner of the present invention makes a significant contribution to biomass production and can meet a desired image quality, it is favorably used in electrophotographic image forming apparatuses, electrophotographic image forming methods, developers, toner containers and process cartridges.

What is claimed is:

1. A toner comprising:

a binder resin, and a colorant, wherein the toner has a concentration of radioactive carbon isotope $^{14}C$ of 10.8 pMC or higher.

2. The toner according to claim 1, wherein the binder resin is a polyester resin obtained by polycondensation of an alcohol component with a carboxylic acid component containing a rosin compound in an amount of 5% by mass or more relative to the total mass of the alcohol component and the carboxylic acid component, and the amount of the polyester resin contained in the toner is 20 parts by mass or more relative to 100 parts by mass of the total amount of the toner.

3. The toner according to claim 1, wherein the binder resin comprises at least a polyester resin (A) and a polyester resin (B) whose softening point is 10° C. or more higher than the softening point of the polyester resin (A), and at least one of the polyester resins (A) and (B) contains a resin derived from a (meth)acrylic acid-modified rosin having a polyester unit which is obtained by polycondensation of an alcohol component with a carboxylic acid component containing a (meth) acrylic acid-modified rosin.

4. A developer comprising:

a toner, and a carrier, wherein the toner comprises at least a binder resin, and a colorant, and has a concentration of radioactive carbon isotope $^{14}C$ of 10.8 pMC or higher.

5. An image forming method comprising:

forming a latent electrostatic image on a surface of a latent electrostatic image bearing member, developing the latent electrostatic image using a toner to form a visible image, transferring the visible image onto a recording medium, and fixing the transferred image on the recording medium, wherein the toner comprises at least a binder resin, and a colorant, and has a concentration of radioactive carbon isotope $^{14}C$ of 10.8 pMC or higher.

* * * * *